US007515023B2

(12) United States Patent
Nakatani et al.

(10) Patent No.: US 7,515,023 B2
(45) Date of Patent: Apr. 7, 2009

(54) MICRO-SWITCHING DEVICE AND METHOD OF MANUFACTURING MICRO-SWITCHING DEVICE

(75) Inventors: Tadashi Nakatani, Kawasaki (JP); Takeaki Shimanouchi, Kawasaki (JP); Masahiko Imai, Kawasaki (JP)

(73) Assignees: Fujitsu Limited, Kawasaki (JP); Fujitsu Media Devices Limited, Yokohama-shi (JP)

( * ) Notice: Subject to any disclaimer, the term of this patent is extended or adjusted under 35 U.S.C. 154(b) by 0 days.

(21) Appl. No.: 10/710,589

(22) Filed: Jul. 22, 2004

(65) Prior Publication Data

US 2005/0225921 A1 Oct. 13, 2005

(30) Foreign Application Priority Data

Mar. 31, 2004 (JP) ..... 2004-104378

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 5,578,976 | A * | 11/1996 | Yao | 200/181 |
| 6,307,452 | B1 | 10/2001 | Sun | 333/262 |
| 6,483,395 | B2 * | 11/2002 | Kasai et al. | 200/181 |
| 6,734,770 | B2 * | 5/2004 | Aigner et al. | 335/78 |

FOREIGN PATENT DOCUMENTS

| | | |
|---|---|---|
| JP | 9-17300 | 1/1997 |
| JP | 2001-143595 | 5/2001 |

* cited by examiner

*Primary Examiner*—Elvin G Enad
*Assistant Examiner*—Bernard Rojas
(74) *Attorney, Agent, or Firm*—Kratz, Quintos & Hanson, LLP

(57) ABSTRACT

A micro-switching device includes a base substrate and a cantilever fixed to the base substrate via a spacer or anchor portion. The cantilever has an inner surface facing the substrate and an outer surface opposite to the inner surface. A conductive strip is formed on the outer surface of the cantilever. The switching device also includes a pair of stationary electrodes fixed to the base substrate. Each of the electrodes includes a downward contacting part spaced from the conductive strip on the cantilever. As the cantilever bends upward, the conductive strip is brought into contact with the contacting parts of the respective stationary electrodes.

10 Claims, 24 Drawing Sheets

101
103
102
S'

133
131
101
S'

141
141
142
141
141
142
101

104
104

104
104a
104a
104

104
104c
104c
104
104b
104b 105
105b
104
105a
105a
105
104

105
134
132
105
132

104
104
103

134
132
132
X1
S1

101
103
102
S'

340
101

131
101

340
106

142
141
141
141
141
142

107
107

107
107a
131
107a 107
107b
107b 108
108a
108a
108

108
132
108
132

107
107
107
103
103

106

S3

MICRO-SWITCHING DEVICE AND METHOD OF MANUFACTURING MICRO-SWITCHING DEVICE

BACKGROUND OF THE INVENTION

1. Field of the Invention

The present invention relates to a minute switching device manufactured using MEMS technology, and a method of manufacturing such a switching device.

2. Description of the Related Art

In the technical field of wireless communication equipment such as mobile phones, as for example the number of components installed in the equipment is increased to realize improved performance, there have been increased demands to miniaturize high-frequency circuitry and RF circuitry. To answer to these demands, there have been advances in miniaturization using MEMS (micro-electromechanical systems) technology for various components constituting the circuitry.

A MEMS switch is an example of such components. Specifically, a MEMS switch is a switching device in which each part is formed minutely using MEMS technology. The switch may include a pair of contacts for carrying out switching by mechanically opening/closing, and a driving mechanism for achieving the mechanical opening/closing operation of the contacts. In switching of high-frequency signals of GHz order in particular, a MEMS switch can exhibit higher insulation in the open state and lower insertion loss in the closed state than a switching device incorporating a PIN diode, a MESFET or the like. This is due to the open state being achieved through mechanical opening between a pair of contacts, and the parasitic capacitance being low due to being a mechanical switch. MEMS switches are disclosed in Japanese Patent Application Laid-open No. 9-17300 and Japanese Patent Application Laid-open No. 2001-143595, for example.

FIGS. 24 and 25 show a conventional MEMS micro-switching device X4. The micro-switching device X4 includes a substrate 401, a movable portion 402, a movable contact part 403, a pair of stationary contact electrodes 404, and driving electrodes 405 and 406. The movable portion 402 has an anchor portion 402*a* that is joined to the substrate 401, and an arm portion 402*b* extending out from the anchor portion 402*a* along the substrate 401. The movable contact part 403 is provided on a lower surface of the arm portion 402*b*. The driving electrode 405 is provided on an upper surface side of the arm portion 402*b*. A wiring part 407, continuing on from the driving electrode 405, is provided on the movable portion 402. The pair of stationary contact electrodes 404 are disposed on the substrate 401 in a manner such that one end of each of the stationary contact electrodes 404 faces the movable contact part 403. The driving electrode 406 is grounded and provided on the substrate 401 in a position corresponding to the driving electrode 405. Prescribed wiring patterns (omitted from the drawings) electrically connected to the stationary contact electrodes 404 and the driving electrode 406 are formed on the substrate 401.

With the micro-switching device X4 having the above arrangement, when a prescribed potential is applied to the driving electrode 405 via the wiring part 407, an electrostatic attractive force is generated between the driving electrodes 405 and 406. As a result, the arm part 402*b* elastically deforms to a position in which the movable contact part 403 contacts the stationary contact electrodes 404. In this way, the closed state of the micro-switching device X4 is achieved. In the closed state, the stationary contact electrodes 404 are electrically bridged by the movable contact part 403, and hence a current is allowed to pass between the stationary contact electrodes 404.

When the electrostatic attractive force acting between the driving electrodes 405 and 406 is eliminated, then the arm part 402*b* returns to its natural state, and hence the movable contact part 403 separates away from the stationary contact electrodes 404. In this way, the open state of the micro-switching device X4 as shown in FIG. 25 is achieved. In the open state, the stationary contact electrodes 404 are electrically isolated from one another, and hence a current is prevented from passing between the stationary contact electrodes 404.

FIGS. 26A-26D and 27A-27D show some of the steps in a method of manufacturing the micro-switching device X4. In the manufacture of the micro-switching device X4, first, as shown in FIG. 26A, the stationary contact electrodes 404 and the driving electrode 406 are pattern-formed onto the substrate 401. Specifically, a film of a prescribed electrically conductive material is formed on the substrate 401, and then a prescribed resist pattern is formed on the electrically conductive film using a photolithography method, and the electrically conductive film is subjected to etching treatment using the resist pattern as a mask. Next, as shown in FIG. 26B, a sacrificial layer 410 is formed. Specifically, using for example a sputtering method, a prescribed material is deposited or grown on the substrate 401 so as to cover the stationary contact electrodes 404 and the driving electrode 406. Next, through etching treatment carried out using a prescribed mask, as shown in FIG. 26C, a single recess 411 is formed in the sacrificial layer 410 in a place in correspondence with the stationary contact electrodes 404. Next, as shown in FIG. 26D, a film of a prescribed material is formed in the recess 411, thus forming the movable contact part 403.

Next, as shown in FIG. 27A, a material film 412 is formed using, for example, a sputtering method. Next, as shown in FIG. 27B, the driving electrode 405 and the wiring part 407 are pattern-formed on the material film 412. Specifically, a film of a prescribed electrically conductive material is formed on the material film 412, and then a prescribed resist pattern is formed on the electrically conductive film using a photolithography method, and the electrically conductive film is subjected to etching treatment using the resist pattern as a mask. Next, as shown in FIG. 27C, the material film 412 is patterned, thus forming a film body 413 constituting the arm part 402*b* and part of the anchor part 402*a*. Specifically, a prescribed resist pattern is formed on the material film 412 using a photolithography method, and then the material film 412 is subjected to etching treatment using the resist pattern as a mask. Next, as shown in FIG. 27D, the other part of the anchor part 402*a* is formed. Specifically, the sacrificial layer 410 is subjected to isotropic etching treatment via the film body 413 which acts as an etching mask, this being such that an undercut is formed below the arm part 402*b* while the abovementioned other part of the anchor part 402*a* is formed by being left behind.

One of the properties required of a switching device is low insertion loss in the closed state. Moreover, given that a reduction in the insertion loss of the switching device is to be aimed for, it is desirable for the electrical resistance of the stationary contact electrodes to be low.

However, with the micro-switching device X4 described above, it is difficult to make the stationary contact electrodes 404 thick, and in actual practice the thickness of the stationary contact electrodes 404 is about 2 μm at most. This is because it is necessary to secure the flatness of the upper surface in the drawing (the growth end face) of the sacrificial layer 410 that is temporarily formed in the process of manufacturing the micro-switching device X4.

As described above with reference to FIG. 26B, the sacrificial layer 410 is formed by a prescribed material being deposited or growing on the substrate 401 so as to cover the stationary contact electrodes 404. The growth end face of the sacrificial layer 410 will thus become stepped due to the thickness of the stationary contact electrodes 404. The thicker the stationary contact electrodes 404, the larger the steps, and the larger the steps, the more difficult it tends to become to form the movable contact part 403 in the proper position or form the arm part 402*b* in the proper shape. Moreover, in the case that the thickness of the stationary contact electrodes 404 is greater than a certain value, the sacrificial layer 410 formed on the substrate 401 may break due to the thickness of the stationary contact electrodes 404. If the sacrificial layer 410 breaks, then it will not be possible to form the movable contact part 403 and the arm part 402*b* on the sacrificial layer 410 properly. With the micro-switching device X4, it is thus necessary to make the stationary contact electrodes 404 sufficiently thin that inappropriate steps are not formed on the growth end face of the sacrificial layer 410. With the micro-switching device X4, it may thus be difficult to realize a sufficiently low resistance for the stationary contact electrodes 404, and as a result it may not be possible to realize a low insertion loss.

SUMMARY OF THE INVENTION

The present invention has been proposed under the circumstances described above. It is therefore an object of the present invention to provide a micro-switching device suitable for reducing the insertion loss. Another object of the present invention is to provide a method of manufacturing such a micro-switching device.

According to a first aspect of the present invention, there is provided a micro-switching device comprising: a base substrate; a movable portion including an anchor part and an extending part, the anchor part being connected to the base substrate, the extending part extending from the anchor part and facing the base substrate; a movable contact part provided on the extending part on a side opposite to the base substrate; a first stationary contact electrode fixed to the base substrate and including a first contacting part facing the movable contact part; and a second stationary contact electrode fixed to the base substrate and including a second contacting part facing the movable contact part.

With the above arrangement, the stationary contact electrodes are not disposed between the base substrate and the extending part of the movable portion. Consequently, in manufacturing the device, there is no need to follow a series of conventional processes of forming the stationary contact electrodes on the base substrate, forming a sacrifice layer so as to cover the stationary contact electrodes, and then forming the extending part on the sacrificial layer.

The stationary contact electrodes in the device of the present invention may be formed, for example, by depositing or growing a material using a plating method on the side opposite to the base substrate via the extending part. The thickness of the stationary contact electrodes can thus be set sufficiently great to realize the desired low resistance. Such a micro-switching device is suitable for reducing the insertion loss.

Preferably, the micro-switching device of the present invention may further comprise a first driving electrode provided on the movable portion on a side opposite to the base substrate, and a second driving electrode fixed to the base substrate and including a section facing the first driving electrode.

Preferably, the micro-switching device of the present invention may further comprise a first driving electrode provided on the movable portion on a side opposite to the base substrate, a piezoelectric film disposed on the first driving electrode, and a second driving electrode disposed on the piezoelectric film.

Preferably, the extending part may be made of monocrystalline silicon so as to suppress internal stress in the extending part. The internal stress is unfavorable since it can cause deformation of the extending part. Preferably, the extending part may have a thickness of at least 5 μm, i.e. no smaller than 5 μm. This arrangement is suitable for suppressing unwanted deformation of the extending part.

Preferably, the first stationary contact electrode or the second stationary contact electrode or both may have a thickness of no smaller than 5 μm.

According to a second aspect of the present invention, there is provided a micro-switching device comprising: a base substrate; a movable portion including an anchor part and an extending part, the anchor part being connected to the base substrate, the extending part extending from the anchor part and facing the base substrate; a stationary member connected to the base substrate; a movable contact part provided on the extending part on a side opposite to the base substrate; a first stationary contact electrode connected to the stationary member and including a first contacting part facing the movable contact part; and a second stationary contact electrode connected to the stationary member and including a second contacting part facing the movable contact part.

Preferably, the stationary member may be spaced away from the movable portion.

Preferably, the stationary member may entirely surround the movable portion.

Preferably, the stationary member may include a plurality of stationary islands that are spaced away from one another and are each connected to the base substrate.

The micro-switching device according to the second aspect of the present invention may further comprise a first driving electrode provided on the movable portion on a side opposite to the base substrate, and a second driving electrode connected to the stationary member and including a section facing the first driving electrode.

Preferably, the extending part may be made of monocrystalline silicon.

Preferably, at least one of the first stationary contact electrode and the second stationary contact electrode may have a thickness of no smaller than 5 μm.

Preferably, the extending part may have a thickness of no smaller than 5 μm.

According to a third aspect of the present invention, there is provided a method of manufacturing the above micro-switching device. The method comprises: a step of preparing a material substrate including a first layer, a second layer and an intermediate layer disposed between the first layer and the second layer, the first layer including a first section, a second section and a third section, the first section being processed into the extending part, the second section being continuous with the first section and processed into the anchor part, the third section being processed into the stationary member; a first electrode formation step of forming the movable contact part on the first section of the first layer; a first etching step of performing anisotropic etching on the first layer until the intermediate layer is reached, the anisotropic etching being performed via a mask pattern that masks the first section, the second section and the third section of the first layer; a sacrifice layer formation step of forming a sacrifice layer with a first opening and a second opening, the first opening being provided for exposing a first connecting region in the third section, the second opening being provided for exposing a second connecting region in the third section; a second electrode formation step of forming the first stationary contact electrode and the second stationary contact electrode, the first stationary contact electrode being connected to the first connecting region and having the first contacting part facing the movable contact part via the sacrifice layer, the second stationary contact electrode being connected to the second connecting region and having the second contacting part facing the movable contact part via the sacrifice layer; a sacrifice layer removal step of removing the sacrifice layer; and a second etching step of etching away a portion of the intermediate layer disposed between the second layer and the first section of the first layer.

Preferably, in the first electrode formation step, a first driving electrode may also be formed on the first section of the first layer. In the sacrifice layer formation step, a third opening may also be formed in the sacrifice layer for exposing a third connecting region in the third section of the first layer. In the second electrode formation step, a second driving electrode may also be formed, which is connected to the third connecting region and includes a portion facing the first driving electrode via the sacrifice layer.

Other features and advantages of the present invention will become apparent from the detailed description given below with reference to the accompanying drawings.

DETAILED DESCRIPTION OF THE PREFERRED EMBODIMENTS

Preferred embodiments of the present invention will be described below with reference to the accompanying drawings.

Figure 1:
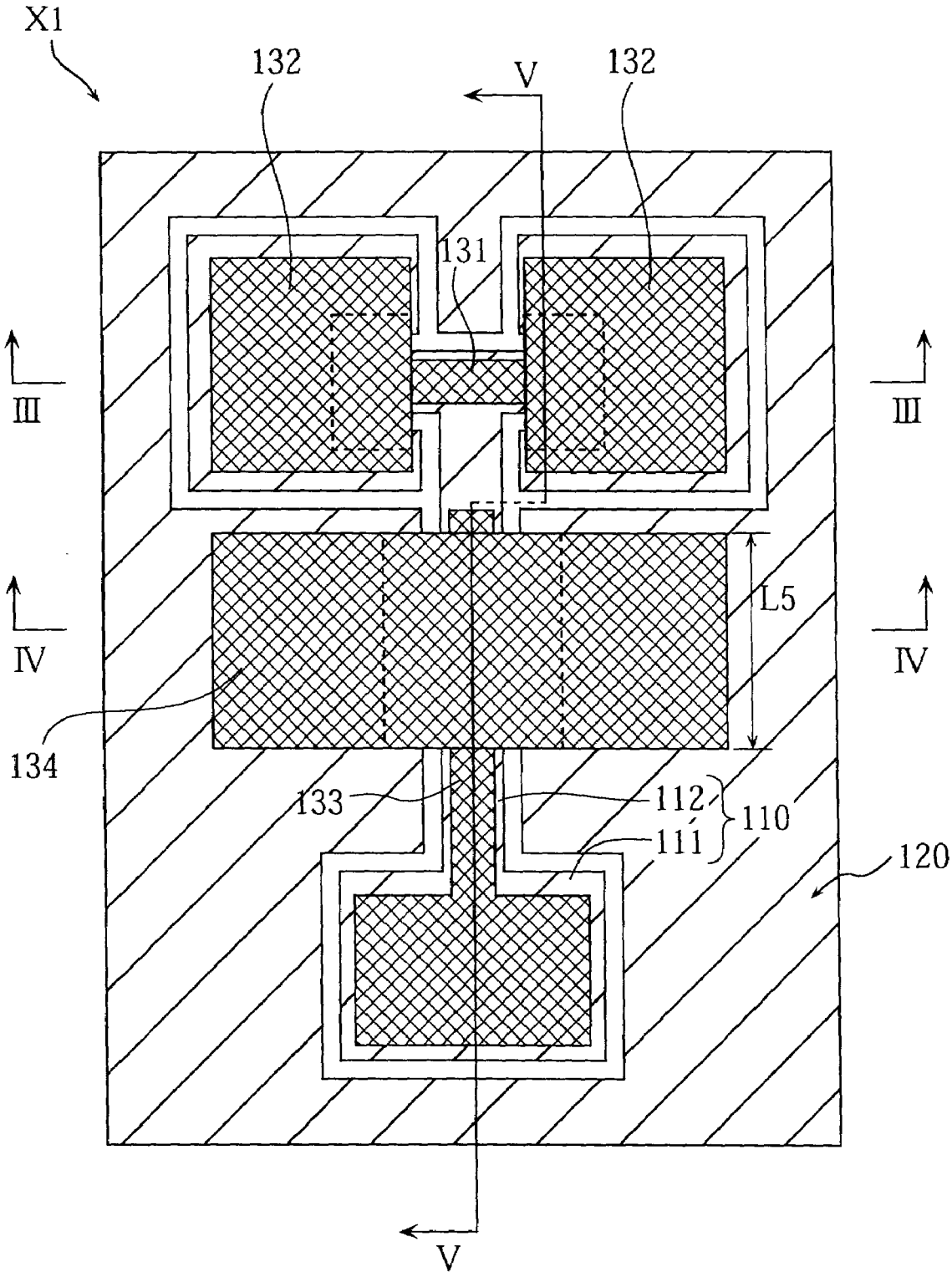
FIG. 1 is a plan view of a micro-switching device according to a first embodiment of the present invention.
Figure 2:
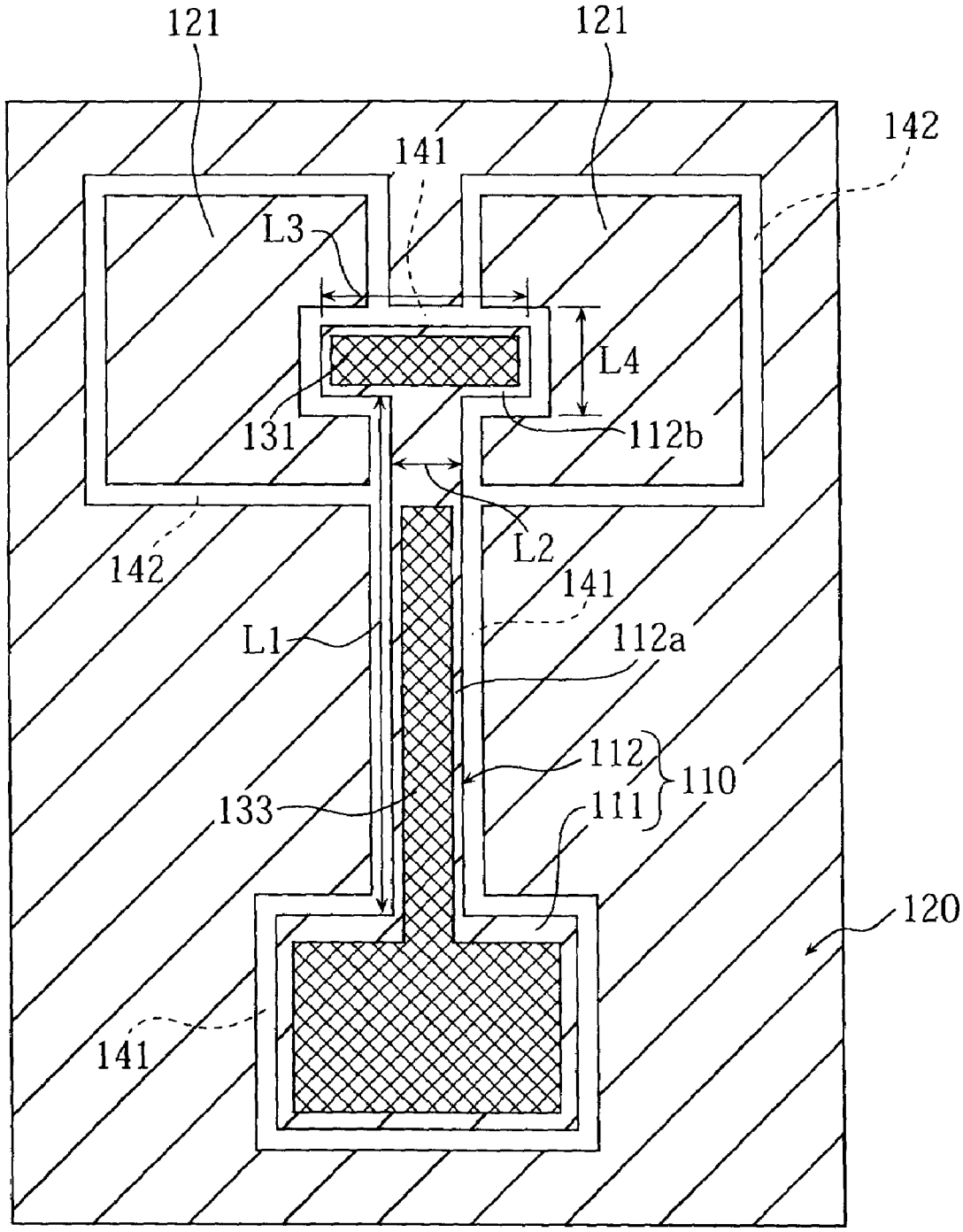
FIG. 2 is a plan view of the micro-switching device of FIG. 1 with some parts omitted.
Figure 3:
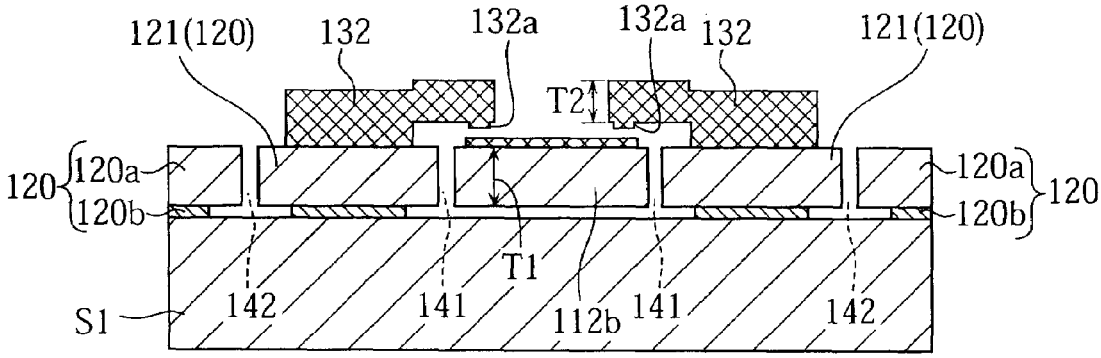
FIG. 3 is a sectional view along line III-III in FIG. 1.
Figure 4:
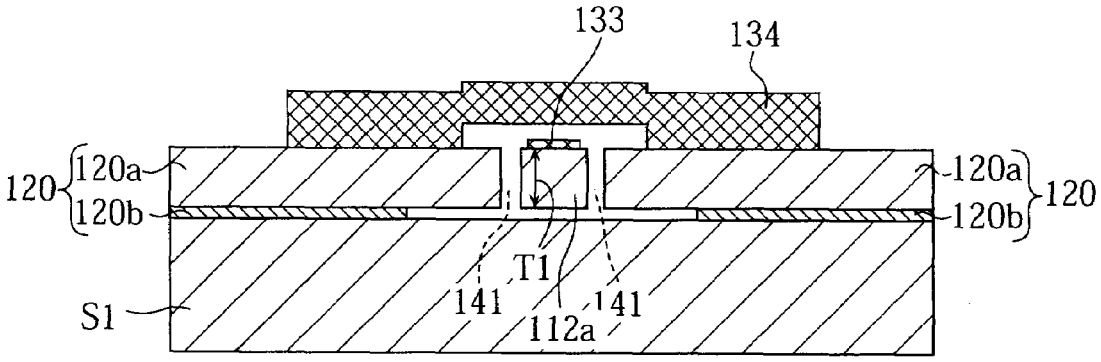
FIG. 4 is a sectional view along line IV-IV in FIG. 1.
Figure 5:
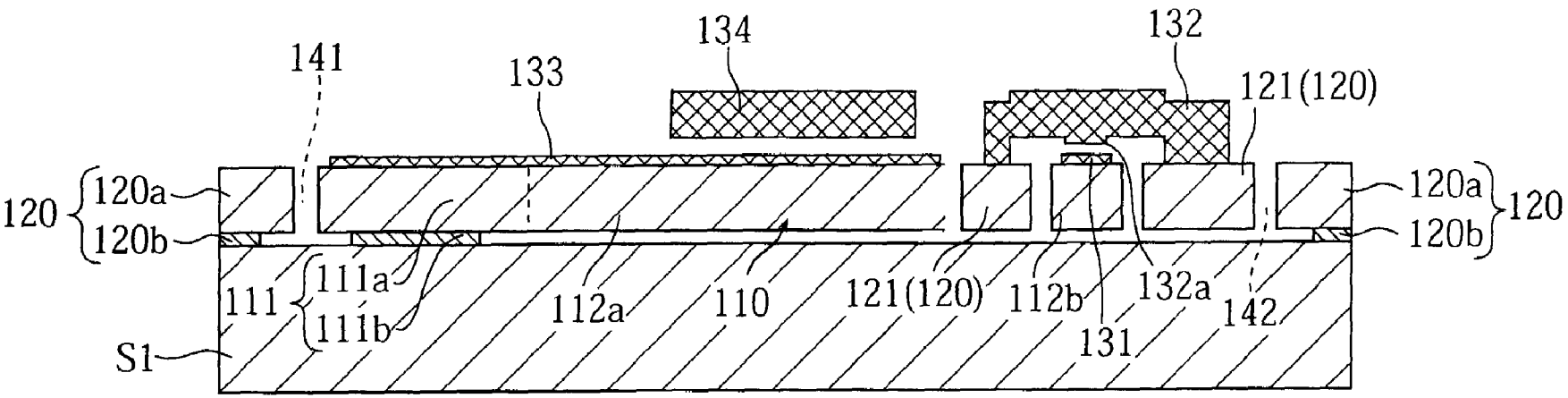
FIG. 5 is a sectional view along line V-V in FIG. 1.

FIGS. 1 to 5 show a micro-switching device X1 according to a first embodiment of the present invention. FIG. 1 is a plan view of the micro-switching device X1, FIG. 2 is a plan view of the micro-switching device X1 with some parts omitted, and FIGS. 3 to 5 are respectively sectional views along lines III-III, IV-IV and V-V in FIG. 1.

The micro-switching device X1 includes a base substrate S1, a movable cantilever portion 110, a fixing member 120, a movable contact conductor 131, a pair of stationary contact electrodes 132 (omitted from FIG. 2), a first driving electrode 133, and a second driving electrode 134 (omitted from FIG. 2).

The movable cantilever portion 110 has an anchor part 111 and an extending part 112. As shown in FIG. 5, the anchor part 111 has a layered structure having a main layer 111*a* and a boundary layer 111*b*, and is joined to the base substrate S1 on the boundary layer 111*b* side. As shown for example in FIGS. 2 and 5, the extending part 112 has a body 112*a* and a head 112*b*, and extends from the anchor part 111 along the base substrate S1, i.e. in a manner facing the base substrate S1. For the extending part 112, the thickness T1 shown in FIGS. 3 and 4 may be 5 μm or more, in other words, no smaller than 5 μm. For the body 112*a*, the length L1 shown in FIG. 2 is, for example, 400 μm, and the length L2 is, for example, 30 μm. For the head 112*b*, the length L3 shown in FIG. 2 is, for example, 100 μm, and the length L4 is, for example, 30 μm. The main layer 111*a* of the anchor part 111 and the extending part 112 are made, for example, of, monocrystalline silicon, and the boundary layer 111*b* of the anchor part 111 is made, for example, of, silicon dioxide. In the case that the extending part 112 is made of monocrystalline silicon, inappropriate internal stress will not arise in the extending part 112. With a conventional MEMS switch, a thin film formation technique may be used as the method of forming the extending part of the movable cantilever portion, but in this case, internal stress will arise in the extending part formed, and due to this internal stress a problem will arise in that the extending part itself will deform inappropriately. Such inappropriate deformation of the extending part will cause deterioration in various properties of the MEMS switch and is thus undesirable.

As shown in FIGS. 3 and 4, the fixing member 120 has a layered structure having a main layer 120*a* and a boundary layer 120*b*, and is joined to the base substrate S1 on the boundary layer 120*b* side. The main layer 120*a* of the fixing member 120 is made, for example, of, monocrystalline silicon, and the boundary layer 120*b* is made, for example, of, silicon dioxide. Moreover, as shown in FIG. 2, the fixing member 120 includes two island plinths 121, and surrounds the movable portion 110 with a slit 141 therebetween. Each of the island plinths 121 is separated from the rest of the fixing member 120 by a slit 142. The widths of the slits 141 and 142 are, for example, 2 μm. The slits 141 and 142 are helpful in securing an insulated state (a nonconductive state) between the stationary contact electrodes 132, the first driving electrode 133 and the second driving electrode 134.

As shown in FIG. 2, the contact conductor 131 is provided on the head 112*b* of the movable portion 110. As shown in FIGS. 3 and 5, each of the stationary contact electrodes 132 is provided on one of the island plinths 121 of the fixing member 120, and has a contacting part 132*a* facing the contact conductor 131. The thickness T2 of the stationary contact electrodes 132 is, for example, 5 μm or more. Moreover, the stationary contact electrodes 132 are connected via prescribed wiring (omitted from the drawings) to prescribed circuitry to be subjected to switching. The contact conductor 131 and the stationary contact electrodes 132 are each made of an appropriate electroconductive material.

As shown in FIG. 2, the first driving electrode 133 extends over the body 112*a* of the movable portion 110 and the anchor part 111. As shown in FIG. 4, the second driving electrode 134 is provided in a manner such that the two edges thereof are joined to the fixing member 120, thereby straddling over the first driving electrode 133. For the second driving electrode 134, the length L5 shown in FIG. 1 is, for example, 200 μm. Moreover, the second driving electrode 134 is grounded via prescribed wiring (omitted from the drawings). The first driving electrode 133 and the second driving electrode 134 are each made of an appropriate electroconductive material.

With the micro-switching device X1 having the above arrangement, when a prescribed potential is applied to the first driving electrode 133, an electrostatic attractive force is generated between the first driving electrode 133 and the second driving electrode 134. As a result, the extending part 112 elastically deforms to a position in which the contact conductor 131 contacts the stationary contact electrodes 132 or the contacting parts 132*a* of the electrodes. In this way, the closed state of the micro-switching device X1 is achieved. In this closed state, the stationary contact electrodes 132 are electrically bridged by the contact conductor 131, and hence a current is allowed to pass between the stationary contact electrodes 132.

With the micro-switching device X1 in the closed state, when the electrostatic attractive force acting between the first driving electrode 133 and the second driving electrode 134 is eliminated by stopping the application of the voltage to the first driving electrode 133, then the extending part 112 returns to its natural state, and hence the contact conductor 131 separates away from the stationary contact electrodes 132. In this way, the open state of the micro-switching device X1 as shown in FIGS. 3 and 5 is achieved. In the open state, the stationary contact electrodes 132 are electrically isolated from one another, and hence a current is prevented from passing between the stationary contact electrodes 132.

FIGS. 6A-6D, 7A-7C and 8A-8C illustrate a method of manufacturing the micro-switching device X1 through successive changes in two cross sections of the material substrate, one cross section (on the left) corresponding to the view shown in FIG. 3, the other (on the right) corresponding to the view shown in FIG. 4.

Figures 6A, 6B, 6C, 6D:
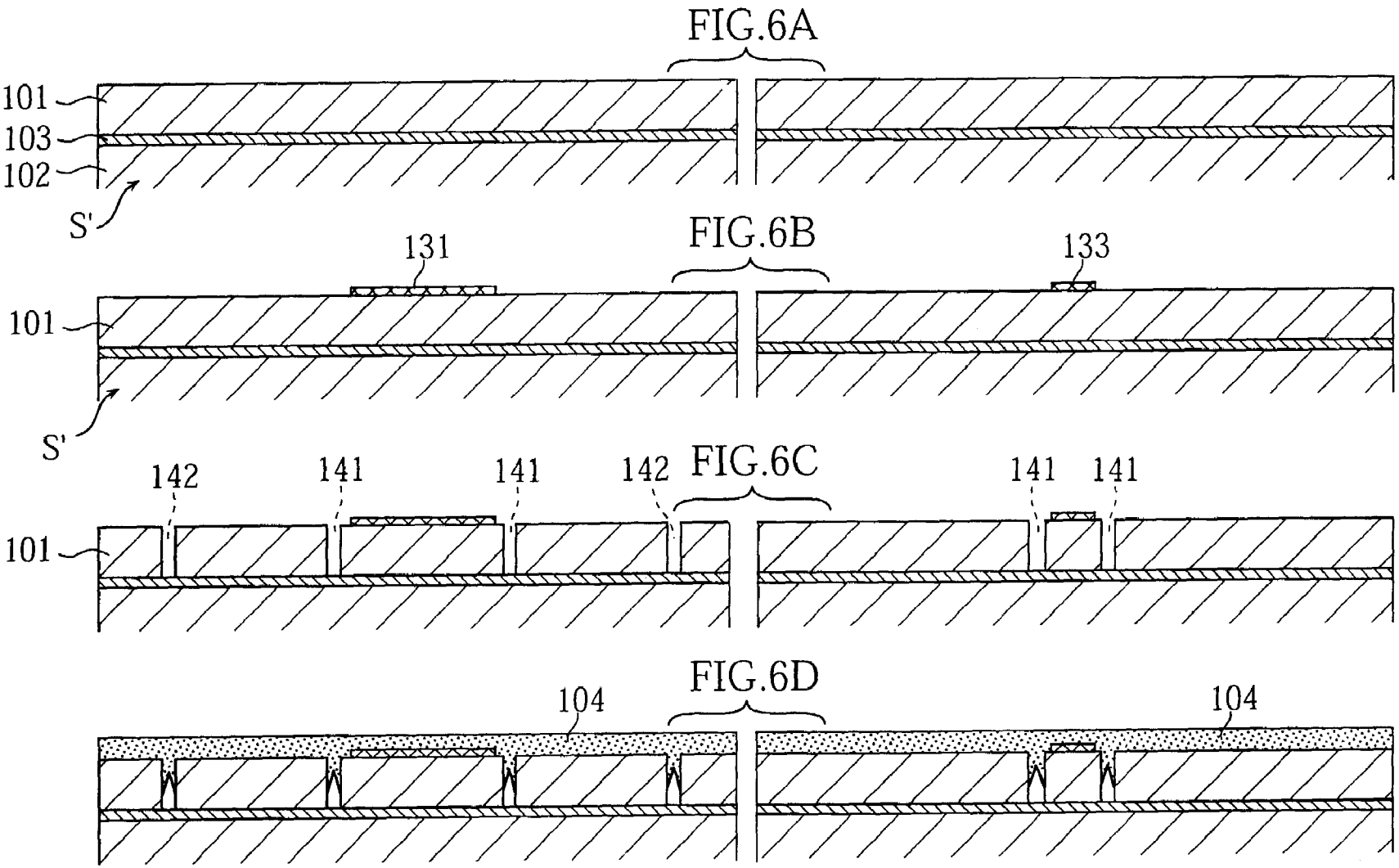
FIGS. 6A-6D show some of the steps in a method of manufacturing the micro-switching device of FIG. 1.

In the manufacture of the micro-switching device X1, first a substrate S' as shown in FIG. 6A is prepared. The substrate S' is an SOI (silicon on insulator) substrate, and has a layered structure having a first layer 101, a second layer 102, and an intermediate layer 103 therebetween. In the present embodiment, for example, the thickness of the first layer 101 is 10 μm, the thickness of the second layer 102 is 400 μm, and the thickness of the intermediate layer 103 is 2 μm. The first layer 101 and the second layer 102 are made, for example, of monocrystalline silicon. The intermediate layer 103 is made, for example, of silicon dioxide.

Next, as shown in FIG. 6B, the contact conductor 131 and the first driving electrode 133 are formed on the first layer 101 of the substrate S'. Specifically, first, using a sputtering method, a film of, for example, Cr is formed on the first layer 101, and then a film of, for example, Au is formed thereon. The thickness of the Cr film is, for example, 50 nm, and the thickness of the Au film is, for example, 500 nm. Next, a prescribed resist pattern is formed on the resulting multi-layered conductor film using a photolithography method, and then the multi-layered conductor film is subjected to etching treatment using the resist pattern as a mask. In this way, the contact conductor 131 and the first driving electrode 133 can be pattern-formed on the first layer 101.

Next, as shown in FIG. 6C, the first layer 101 is subjected to etching treatment, thus forming the slits 141 and 142. Specifically, a prescribed resist pattern is formed on the first layer 101 using a photolithography method, and then the first layer 101 is subjected to etching treatment using the resist pattern as a mask. Ion etching (physical etching using, for example, Ar ions) can be used as the etching method.

Next, as shown in FIG. 6D, a sacrificial layer 104 is formed on the first layer 101 side of the substrate S' such as to block up the slits 141 and 142. As the sacrificial layer material, for example silicon dioxide can be used. Moreover, as the method for forming the sacrificial layer 104, for example plasma CVD or sputtering can be used. The thickness of the sacrificial layer 104 is, for example, 2 μm. In the present step, the sacrificial layer material is also deposited on parts of the sidewalls of the slits 141 and 142, and hence the slits 141 and 142 are blocked up.

Figures 7A, 7B, 7C:
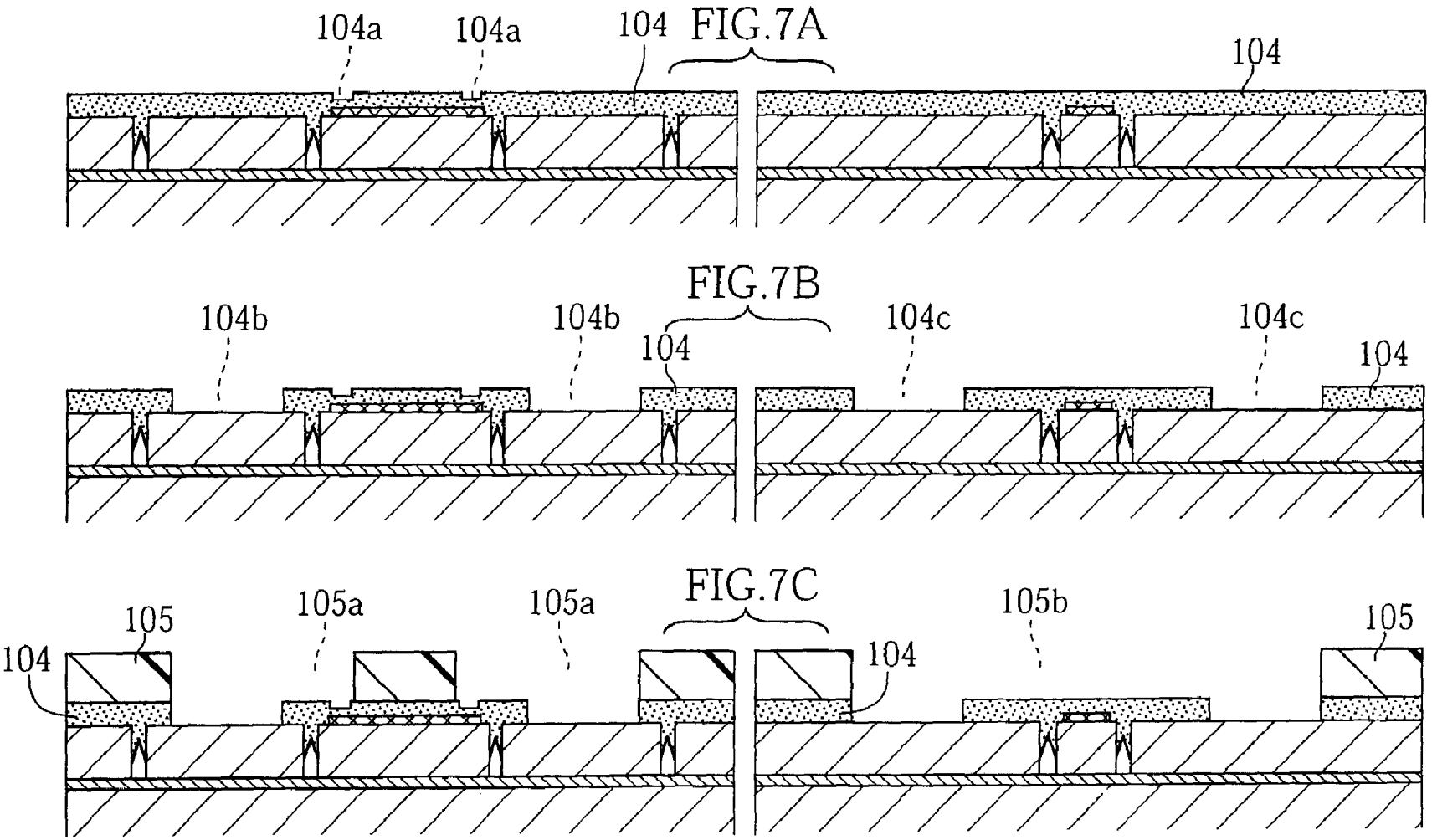
FIGS. 7A-7C show steps following the step of FIG. 6D.

Next, as shown in FIG. 7A, two recesses 104*a* are formed in the sacrificial layer 104 in places in correspondence with the contact conductor 131. Specifically, a prescribed resist pattern is formed on the sacrificial layer 104 using a photolithography method, and then the sacrificial layer 104 is subjected to etching treatment using the resist pattern as a mask. Wet etching may be used as the etching method. Each of the recesses 104*a* is for forming the contacting part 132*a* of one of the stationary contact electrodes 132, and has a depth of, for example, 1 μm.

Next, as shown in FIG. 7B, the sacrificial layer 104 is patterned, thus forming openings 104*b* and 104*c*. Specifically, a prescribed resist pattern is formed on the sacrificial layer 104 using a photolithography method, and then the sacrificial layer 104 is subjected to etching treatment using the resist pattern as a mask. Wet etching can be used as the etching method. The openings 104*b* are for exposing regions where the stationary contact electrodes 132 will be joined to the island plinths 121 of the fixing member 120. The openings 104*c* are for exposing regions where the second driving electrode 134 will be joined to the fixing member 120.

Next, a foundation film (omitted from the drawings) for passing electricity is formed on the surface of the substrate S' on the side on which the sacrificial layer 104 has been provided, and then as shown in FIG. 7C, a mask 105 is formed. The foundation film can be formed, for example, using a sputtering method by forming a Cr film of thickness 50 nm, and then forming an Au film of thickness 500 nm thereon. The mask 105 has therein openings 105*a* in correspondence with the pair of stationary contact electrodes 132, and an opening 105*b* in correspondence with the second driving electrode 134.

Figures 8A, 8B, 8C:
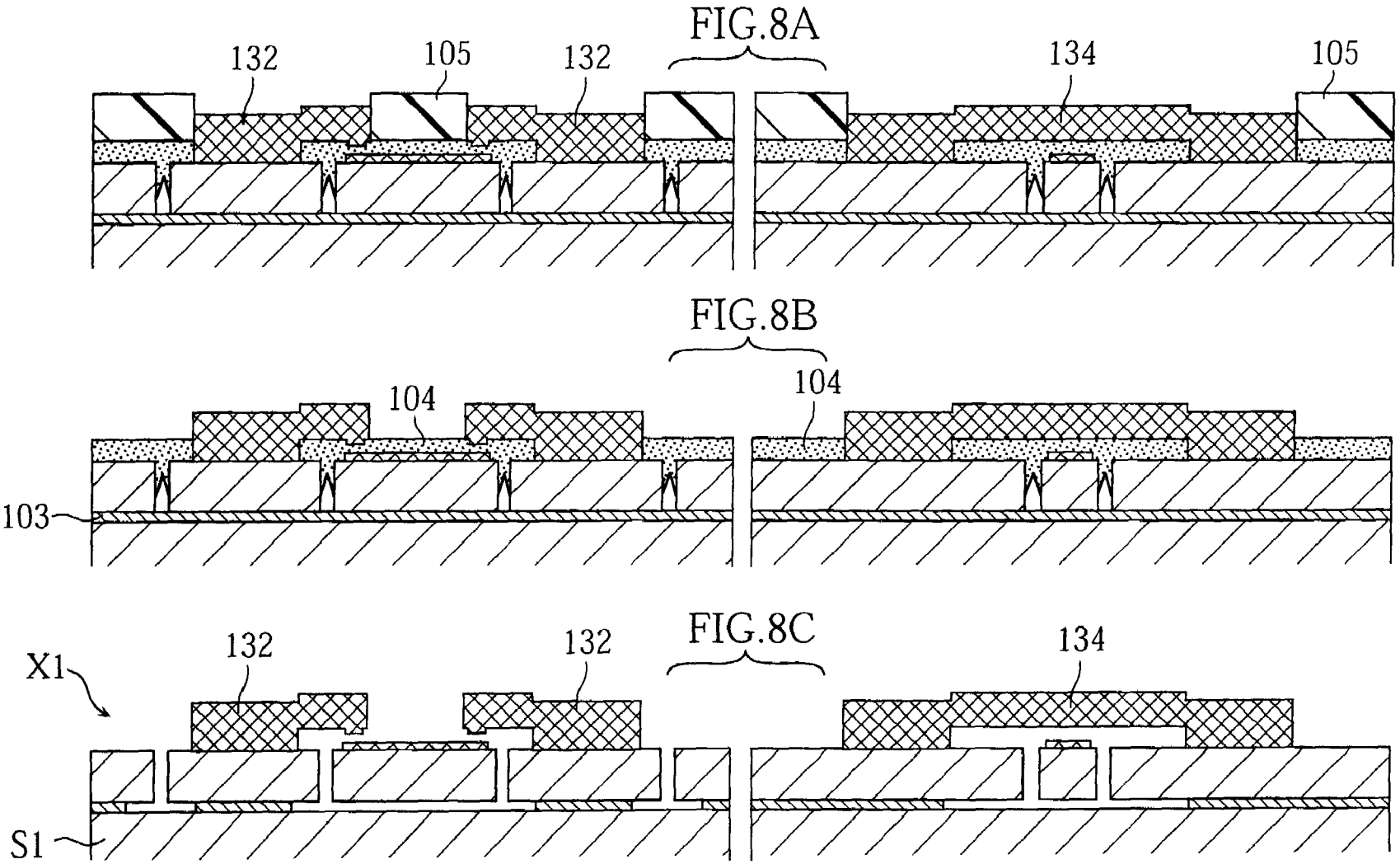
FIGS. 8A-8C show steps following the step of FIG. 7C.

Next, as shown in FIG. 8A, the stationary contact electrodes 132 and the second driving electrode 134 are formed.

Specifically, for example gold is grown using an electroplating method on the foundation film exposed in the openings 105*a* and 105*b*.

Next, as shown in FIG. 8B, the mask 105 is removed by etching. After that, the exposed parts of the foundation film are removed by etching. Wet etching may be used in each of these steps of removal by etching.

Next, as shown in FIG. 8C, the sacrificial layer 104 and parts of the intermediate layer 103 are removed. Specifically, the sacrificial layer 104 and the intermediate layer 103 are subjected to wet etching treatment. Buffered hydrofluoric acid (BHF) can be used as the etchant. In this etching treatment, first the sacrificial layer 104 is removed, and then the intermediate layer 103 starts to be removed from places adjacent to the slits 141 and 142. The etching treatment is stopped after the whole of the extending part 112 of the movable portion 110 has become suitably separated from the substrate S' or the first layer 101. In this way, the boundary layer 111*b* of the anchor part 111 and the boundary layer 120*b* of the fixing member 120 are formed by being left behind. The second layer 102 is to constitute the base substrate S1.

Next, if necessary, part of the foundation film (e.g. the Cr film) attached to the lower surface of each of the stationary contact electrodes 132 and the second driving electrode 134 is removed by wet etching, and then the whole of the device is dried using a supercritical drying method. Due to the supercritical drying, a sticking phenomenon in which the extending part 112 of the movable portion 110 sticks to the base substrate S1 can be avoided.

Through the above procedure, the micro-switching device X1 can be manufactured. With the above method, the stationary contact electrodes 132 each having a contacting part 132*a* facing the contact conductor 131 can be formed to a great thickness on the sacrificial layer 104 using plating. The thickness of the pair of stationary contact electrodes 132 can thus be set sufficiently great to realize the desired low resistance. Such a micro-switching device X1 is suitable for reducing the insertion loss in the closed state.

With the micro-switching device X1, the lower surface of the contacting part 132*a* of each of the stationary contact electrodes 132 (i.e. the surface that contacts the contact conductor 131) has a high degree of flatness, and hence the air gap between the contact conductor 131 and each contacting part 132*a* can be formed with high dimensional precision. This is because the lower surface of each contacting part 132*a* is the starting face of the plating growth for forming the stationary contact electrode 132 in question. Air gaps with high dimensional precision are suitable for reducing the insertion loss of the device in the closed state, and are also suitable for improving the isolation properties of the device in the open state.

In general, in the case that the dimensional precision of the air gaps between the contact conductor and the stationary contact electrodes in a micro-switching device is low, variations in the air gaps between devices will arise. The longer the formed air gaps relative to the design dimension, the more difficult it will be for the contact conductor to contact the stationary contact electrodes during the closing operation of the switching device, and hence the larger the insertion loss of the device will tend to become. On the other hand, the shorter the formed air gaps relative to the design dimension, the lower the insulation between the contact conductor and the stationary contact electrodes will become during the open state of the switching device, and hence the isolation properties of the device will tend to deteriorate. Control of the film thickness is more difficult with plating than with sputtering, CVD or the like, and hence the growth end face of a thick plating film has relatively large undulations and thus a low degree of flatness, and moreover the precision of the position of formation of the growth end face is relatively low. Consequently, with a micro-switching device, in the case that the stationary contact electrodes were each constituted from a thick plating film, with the growth end face of the plating film being used as the surface that is to contact the contact conductor, the dimensional precision of the air gaps between the contact conductor and the stationary contact electrodes would be low, and hence variations in the air gaps would arise between devices. In contrast with this, with the micro-switching device X1, the lower surface of the contacting part 132*a* of each of the stationary contact electrodes 132 is the plating growth starting face and thus has a high degree of flatness, and hence the air gap between the contact conductor 131 and each contacting part 132*a* can be formed with high dimensional precision.

Figure 9:
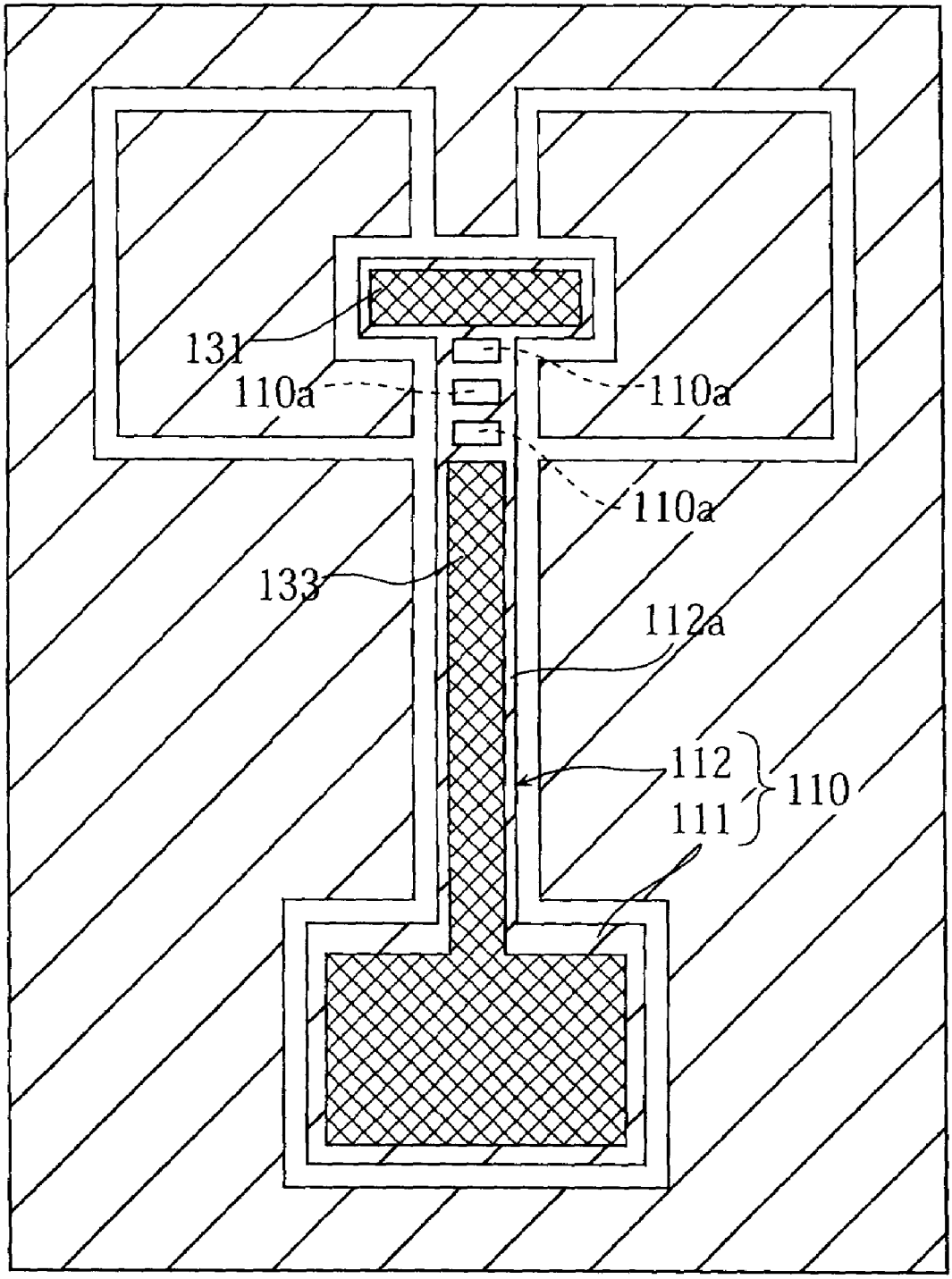
FIG. 9 is a plan view of a modified version of the micro-switching device shown in FIG. 1 with some parts omitted.

With the micro-switching device X1, as shown in FIG. 9, through-holes 110*a* may be formed in the extending part 112 of the movable portion 110. The through-holes 110*a* pass through the body 112*a* of the extending part 112 at the end of the body 112*a* adjacent to the head 112*b*. This arrangement is suitable for improving the electrical insulation between the contact conductor 131 and the first driving electrode 133 on the movable portion 110.

Figure 10:
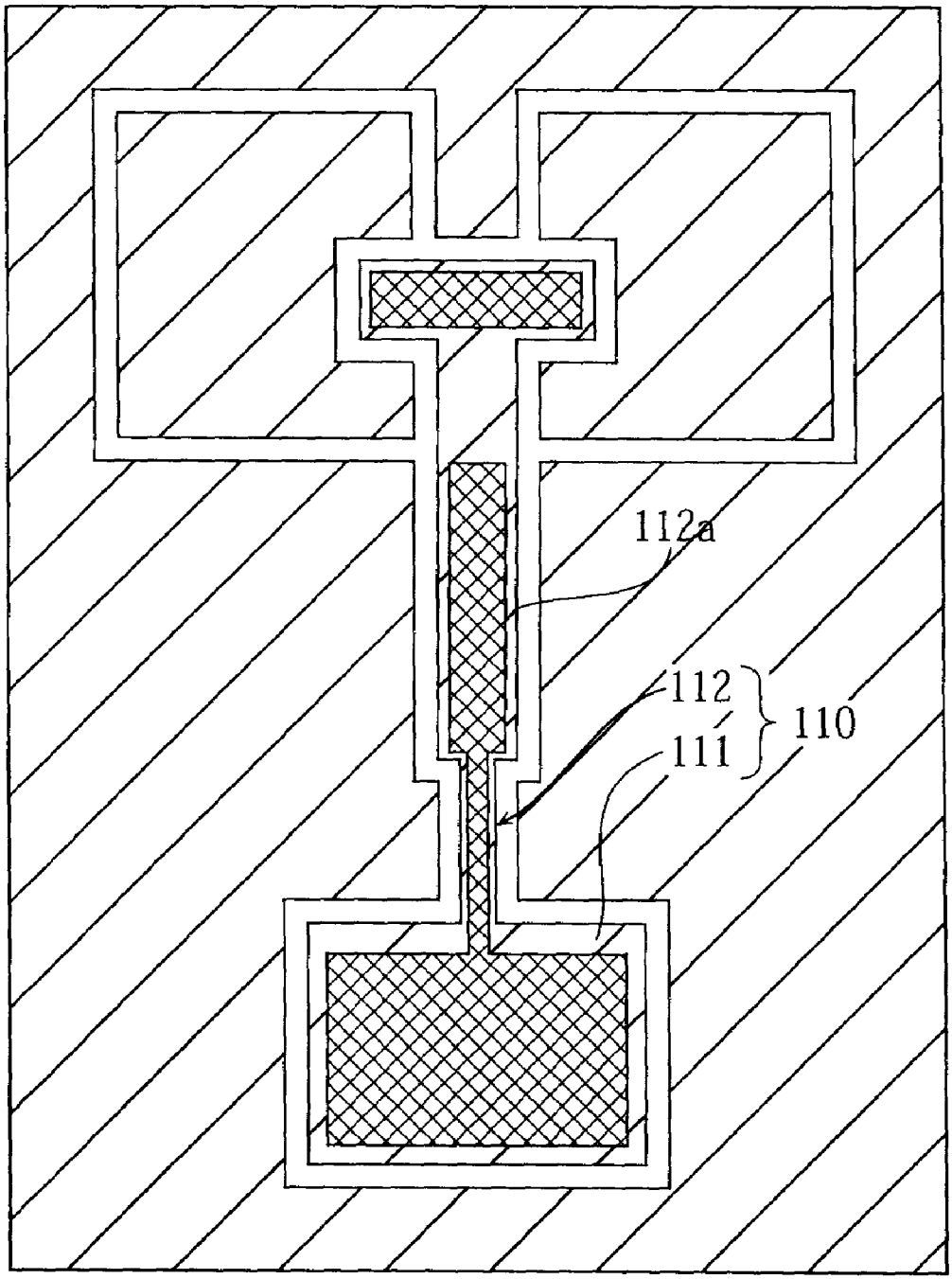
FIG. 10 is a plan view of another modified version of the micro-switching device shown in FIG. 1 with some parts omitted.

With the micro-switching device X1, as shown in FIG. 10, the body 112*a* of the extending part 112 may have a relatively narrow end adjacent to the anchor part 111. This arrangement is suitable for allowing the extending part 112 to undergo elastic deformation, which is advantageous to the reduction of the driving power.

Figure 11:
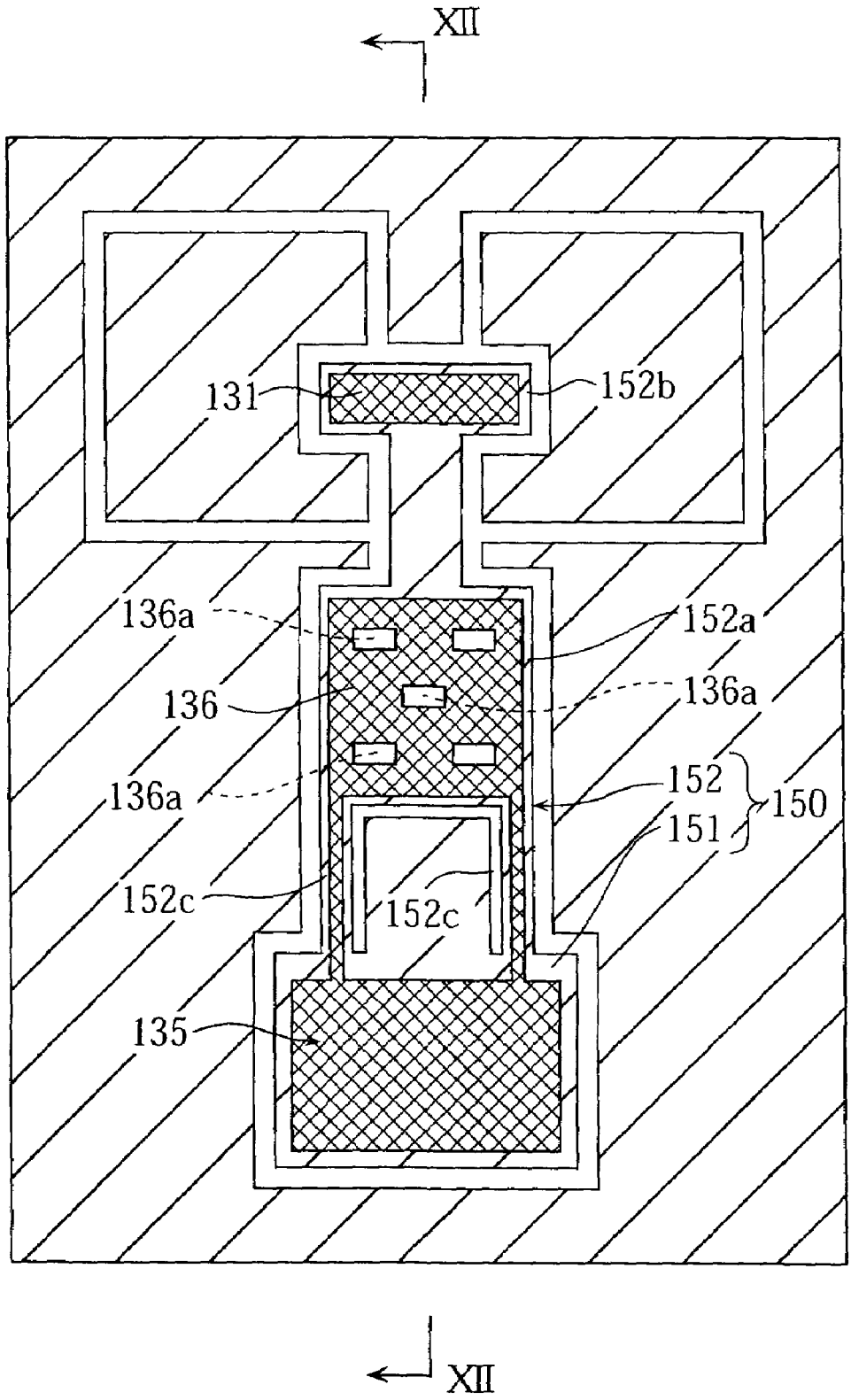
FIG. 11 is a plan view of another modified version of the micro-switching device shown in FIG. 1 with some parts omitted.
Figure 12:
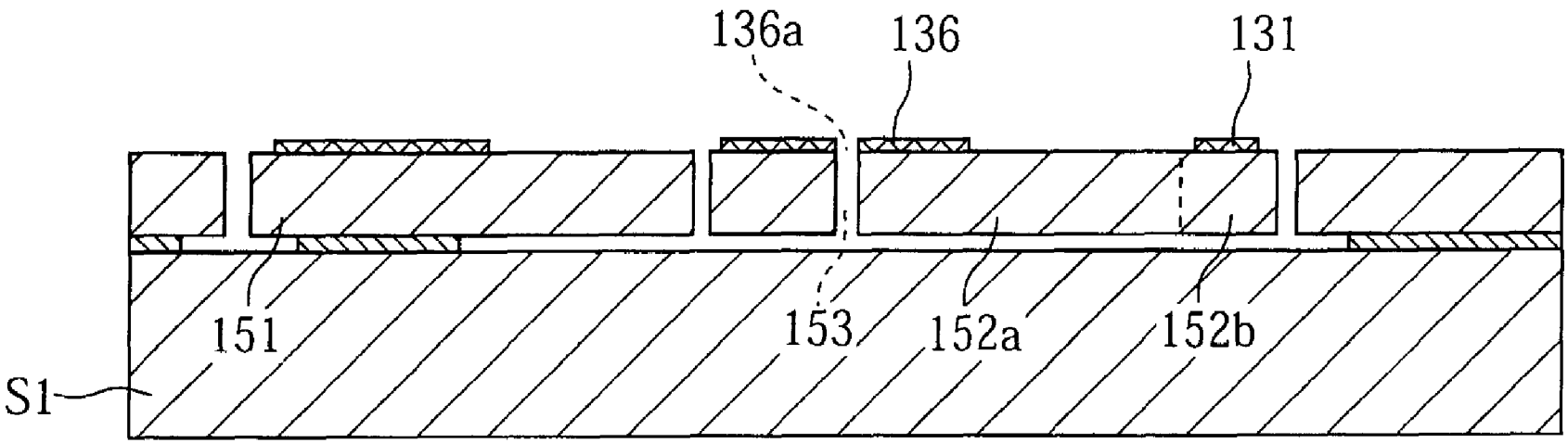
FIG. 12 is a sectional view along line XII-XII in FIG. 11.

As shown in FIGS. 11 and 12, the micro-switching device X1 may have a movable cantilever portion 150 instead of the above-described cantilever portion 110, and may have a first driving electrode 135 instead of the above-mentioned first driving electrode 133. The movable portion 150 has an anchor part 151 and an extending part 152. As shown in FIG. 12, the anchor part 151 is joined to the base substrate S1. The extending part 152 has a body 152*a*, a head 152*b*, and connecting parts 152*c*, and extends out from the anchor part 151 along the base substrate S1. The body 152*a* has a section broader than the body 112*a* described earlier, and has a plurality of through-holes 153 as shown in FIG. 12. The first driving electrode 135 is pattern-formed over the anchor part 151, the connecting parts 152*c* and the body 152*a*, and has a main part 136 over the body 152*a*. The main part 136 is formed with openings 136*a* that communicate with the through-holes 153 in the body 152*a*.

The above arrangement, i.e., the first driving electrode 135 having a broad-area main part 136, is suitable for reducing the driving power. Moreover, because the end part of the extending part 152 on the anchor part 151 side is constituted from the two narrow connecting parts 152*c*, approximately the same degree of elastic deformability can be realized with the extending part 152 as with the extending part 112 described earlier. In addition, in a step of removing the sacrificial layer by etching in the process of manufacturing the present variant (the step corresponding to the step described earlier with reference to FIG. 8C), the etchant can pass through the openings 136*a* in the main part 136 and the through-holes 153 in the body 152*a*, and hence the intermediate layer 103 present below the broad body 152*a* can be removed well by the etching.

Figure 13:
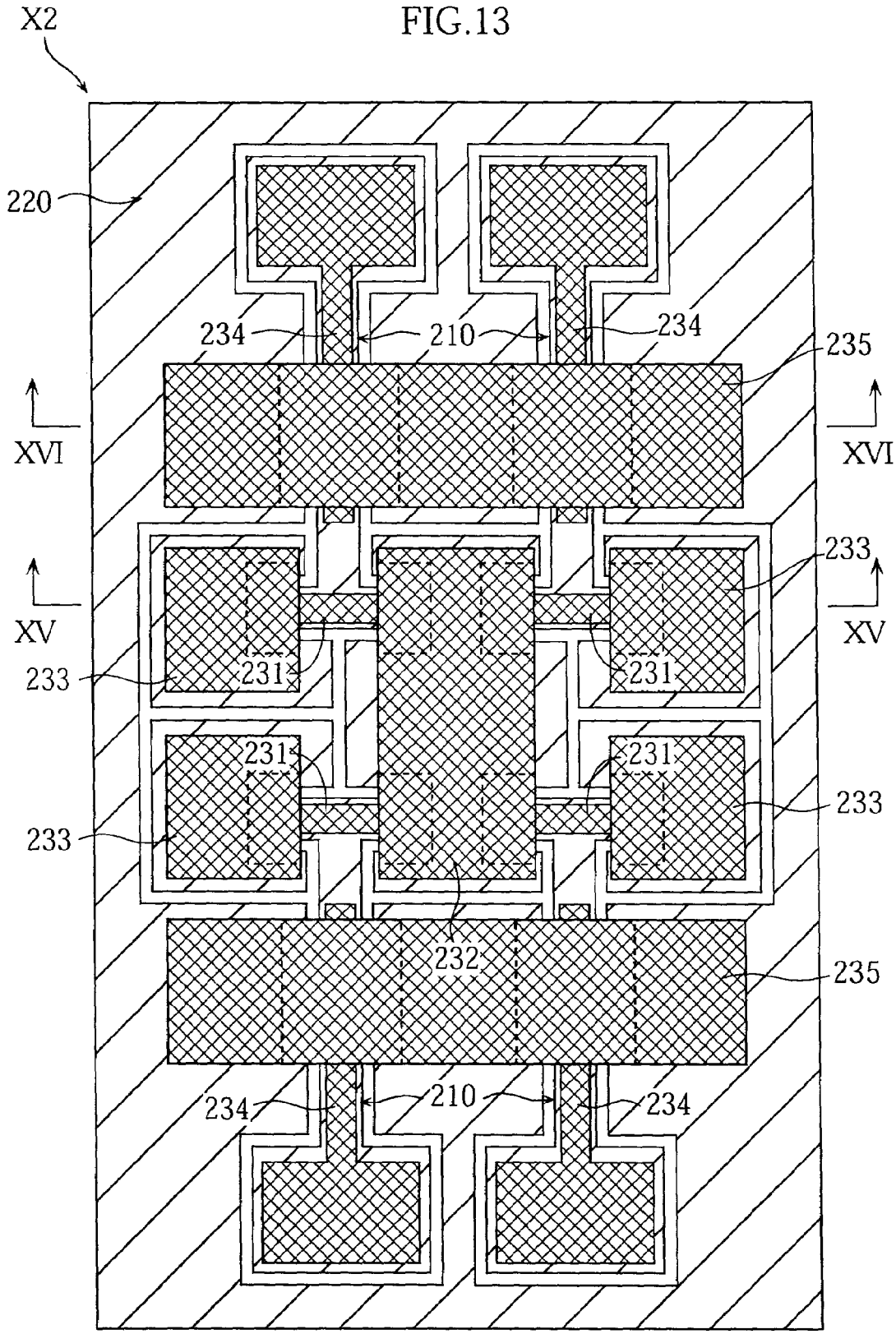
FIG. 13 is a plan view of a micro-switching device according to a second embodiment of the present invention.
Figure 14:
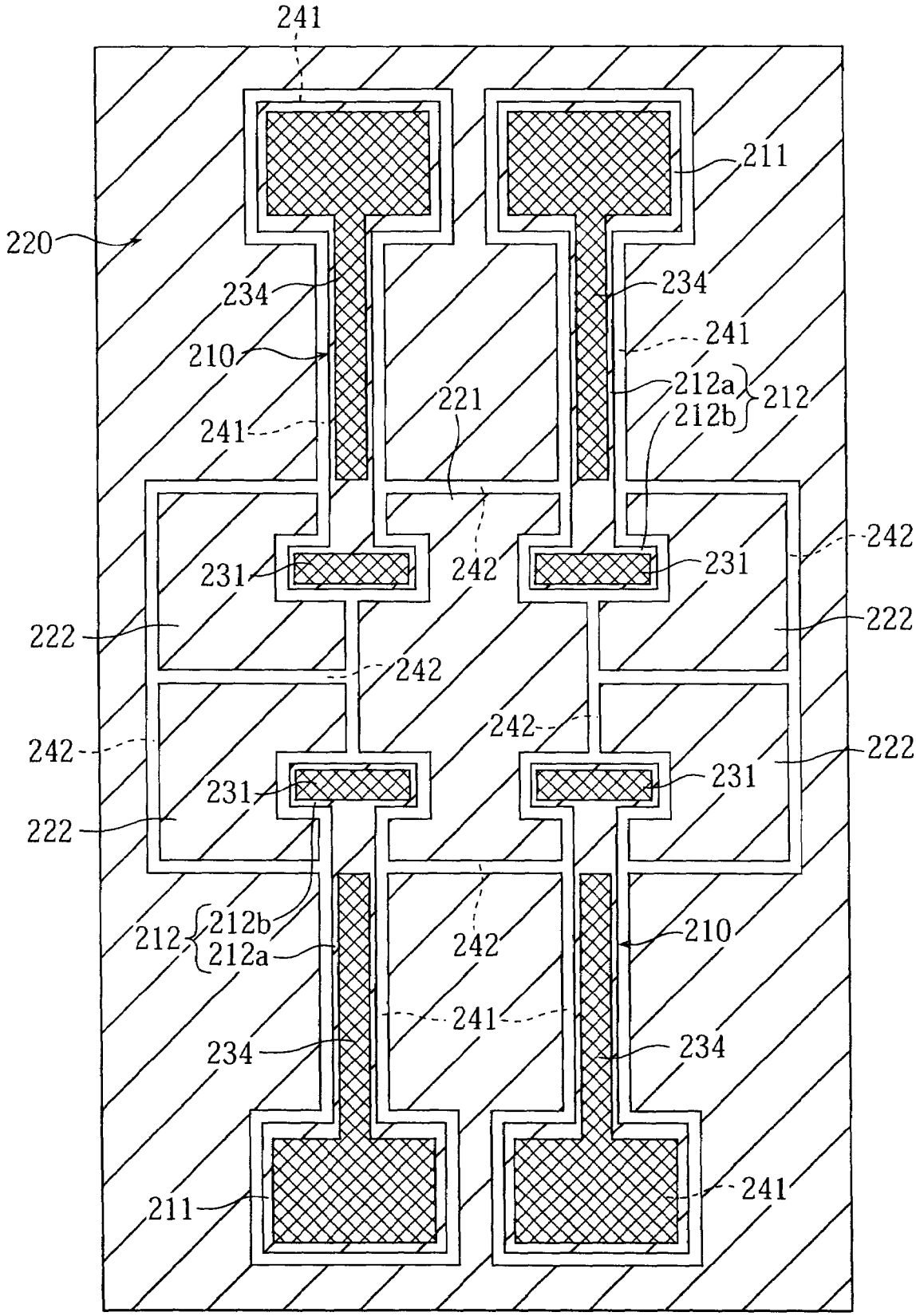
FIG. 14 is a plan view of the micro-switching device of FIG. 13 with some parts omitted.
Figure 15:
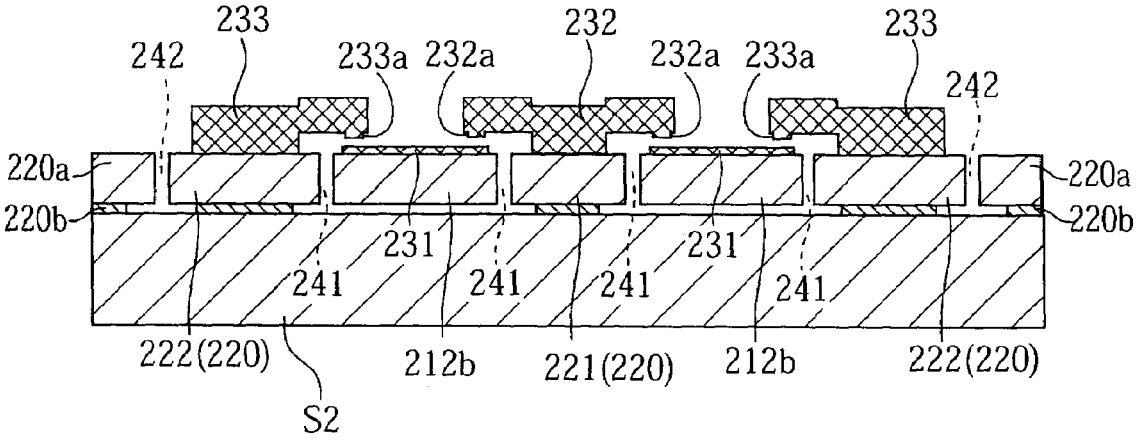
FIG. 15 is a sectional view along line XV-XV in FIG. 13.
Figure 16:
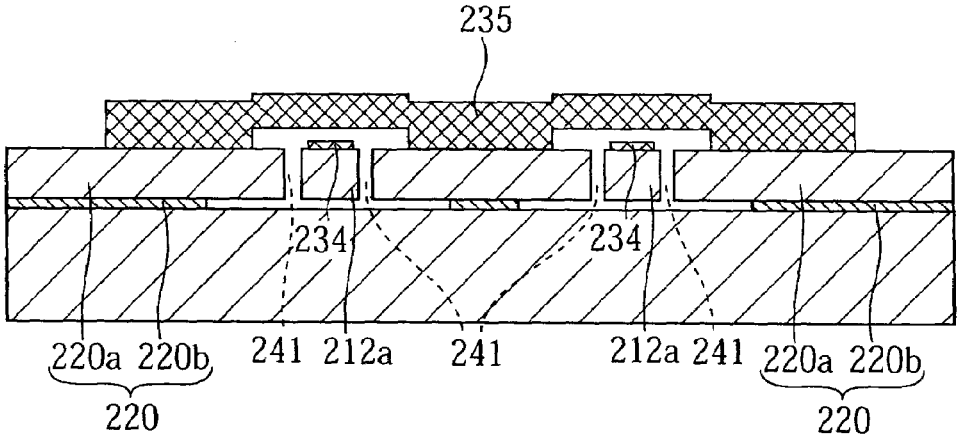
FIG. 16 is a sectional view along line XVI-XVI in FIG. 13.

FIGS. 13 to 16 show a micro-switching device X2 according to a second embodiment of the present invention. FIG. 13 is a plan view of the micro-switching device X2, FIG. 14 is a plan view of the micro-switching device X2 with some parts omitted, and FIGS. 15 and 16 are respectively sectional views along lines XV-XV and XVI-XVI in FIG. 13.

The micro-switching device X2 includes a base substrate S2, four movable cantilever portions 210, a fixing member 220, four movable contact conductors 231, a common contact electrode 232 (omitted from FIG. 14), four stationary individual contact electrodes 233 (omitted from FIG. 14), four first driving electrodes 234, and two second driving electrodes 235 (omitted from FIG. 14). The micro-switching device X2 is provided with four micro-switching devices X1 of the first embodiment.

Each of the movable portions 210 has an anchor part 211 and an extending part 212. As with the anchor part 111 described earlier, the anchor part 211 has a layered structure having a main layer and a boundary layer, and is joined to the base substrate S2 on the boundary layer side. As shown for example in FIG. 14, the extending part 212 has a body 212*a* and a head 212*b*, extending from the anchor part 211 along the base substrate S2, i.e. in a manner facing the base substrate S2. The main layer of the anchor part 211 and the extending part 212 are made, for example, of monocrystalline silicon. The boundary layer of the anchor part 211 is made, for example, of silicon dioxide.

As shown in FIGS. 15 and 16, the fixing member 220 has a layered structure having a main layer 220*a* and a boundary layer 220*b*, and is joined to the base substrate S2 on the boundary layer 220*b* side. Moreover, as shown in FIG. 14, the fixing member 220 includes a central island plinth 221 and four island plinths 222, surrounding the movable portions 210 with slits 241 therebetween. The island plinths 221 and 222 are separated from the other sections of the fixing member 220 by slits 242. The slits 241 and 242 are helpful in securing an insulated state (a nonconductive state) between the stationary contact electrodes 232 and 233, the first driving electrodes 234 and the second driving electrodes 235. The main layer 220*a* of the fixing member 220 is made, for example, of monocrystalline silicon, and the boundary layer 220*b* is made, for example, of silicon dioxide.

As shown in FIG. 14, each of the contact conductors 231 is provided on the head 212*b* of the corresponding movable portion 210. As shown in FIG. 15, the stationary contact electrode 232 stands on the island plinth 221 of the fixing member 220, and has four contacting parts 232*a*. Each of the contacting parts 232*a* faces one of the contact conductors 231. As shown in FIG. 15, each of the stationary contact electrodes 233 stands on one of the island plinths 222 of the fixing member 220, and has a contacting part 233*a* facing one of the contact conductors 231. Moreover, the stationary contact electrodes 232 and 233 are connected via prescribed wiring (omitted from the drawings) to prescribed circuitry to be subjected to switching. The contact conductors 231 and the stationary contact electrodes 232 and 233 are each made of an appropriate electroconductive material.

Each of the first driving electrodes 234 extends over the body 212*a* of the corresponding movable portion 210 and to the anchor part 211. As shown in FIG. 16, each of the second driving electrodes 235 is provided in standing fashion such as to be joined to the fixing member 220 at three places and so as to straddle over two of the first driving electrodes 234. Moreover, the second driving electrodes 235 are grounded via prescribed wiring (omitted from the drawings). The first driving electrodes 234 and the second driving electrodes 235 are each made of an appropriate electroconductive material.

With the micro-switching device X2 having the above arrangement, when a prescribed potential is applied to one of the first driving electrodes 234, an electrostatic attractive force is generated between this first driving electrode 234 and the second driving electrode 235 facing the same. As a result, the corresponding extending part 212 elastically deforms to a position in which the contact conductor 231 contacts the contacting parts 232*a* and 233*a* of the stationary contact electrodes 232 and 233. In this way, the closed state for one channel of the micro-switching device X2 is achieved.

If the electrostatic attractive force acting between the first driving electrode 234 for the channel in the closed state and the corresponding second driving electrode 235 is eliminated by stopping the application of the voltage to this first driving electrode 234, then the corresponding extending part 212 returns to its natural state, and hence the contact conductor 231 separates away from the stationary contact electrodes 232 and 233. In this way, the open state for that channel of the micro-switching device X2 is achieved.

With the micro-switching device X2, as noted above, the opening and closing of the four channels can be controlled by selectively controlling the potentials applied to the four first driving electrodes 234. That is, the micro-switching device X2 can be used as a 1×4 channel switch.

The micro-switching device X2 can be manufactured through a similar process to that described earlier for the micro-switching device X1. Consequently, with the micro-switching device X2, the stationary contact electrode 232 having the contacting parts 232*a* facing the contact conductors 231, and the stationary contact electrodes 233 each having a contacting part 233*a* facing one of the contact conductors 231 can be formed to a great thickness using plating. The stationary contact electrodes 232 and 233 can thus be made sufficiently thick. Such a micro-switching device X2 is suitable for reducing the insertion loss in the closed state.

With the micro-switching device X2, the lower surface of each of the contacting parts 232*a* and 233*a* of the stationary contact electrodes 232 and 233 (i.e. the surface that contacts the contact conductor 231) has a high degree of flatness, and hence the air gaps between the contact conductors 231 and the contacting parts 232*a* and 233*a* can be formed with high dimensional precision. Air gaps with high dimensional precision are suitable for reducing the insertion loss for each channel in the closed state, and are also suitable for improving the isolation properties for each channel in the open state.

Figure 17:
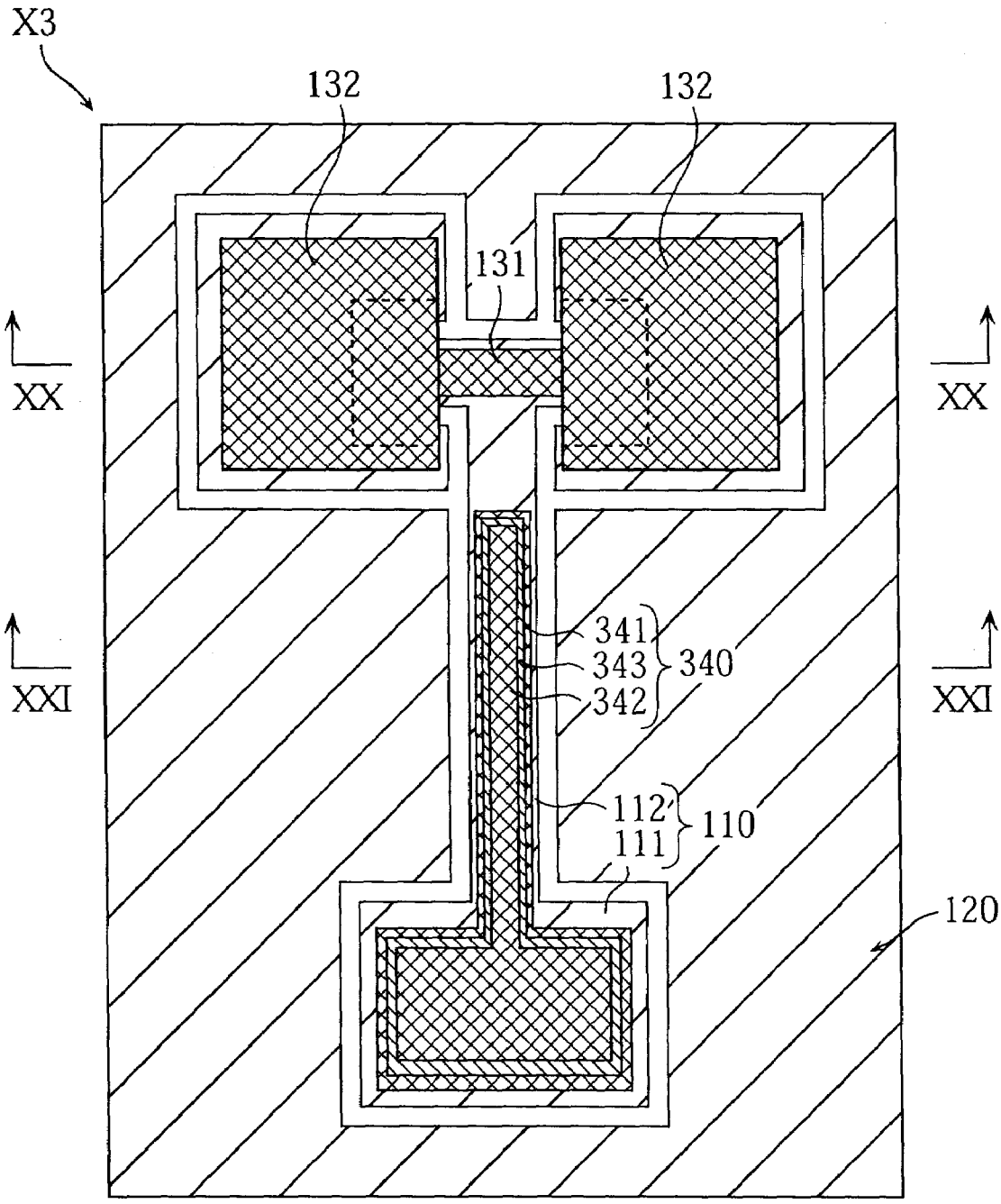
FIG. 17 is a plan view of a micro-switching device according to a third embodiment of the present invention.
Figure 18:
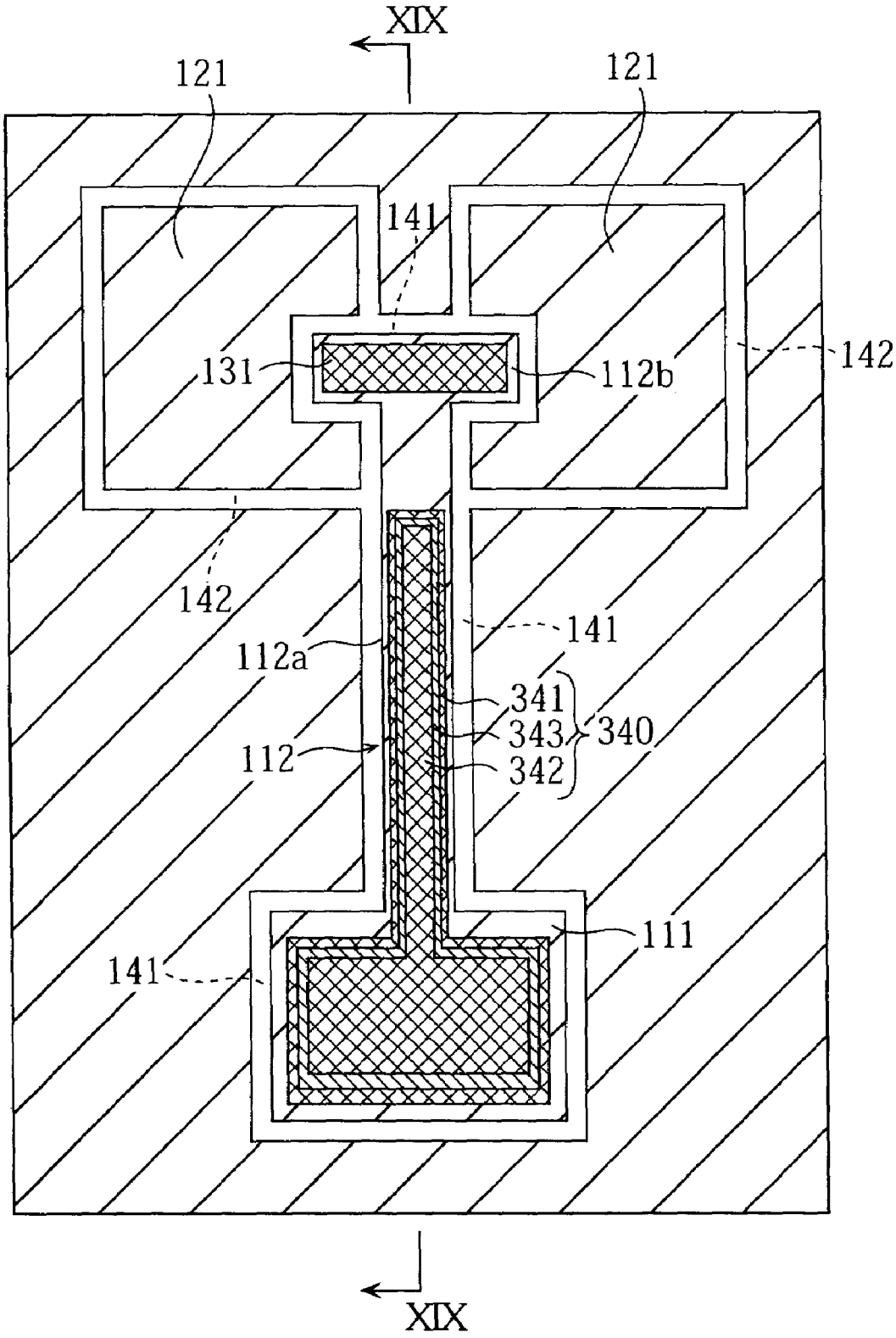
FIG. 18 is a plan view of the micro-switching device of FIG. 17 with some parts omitted.
Figure 19:
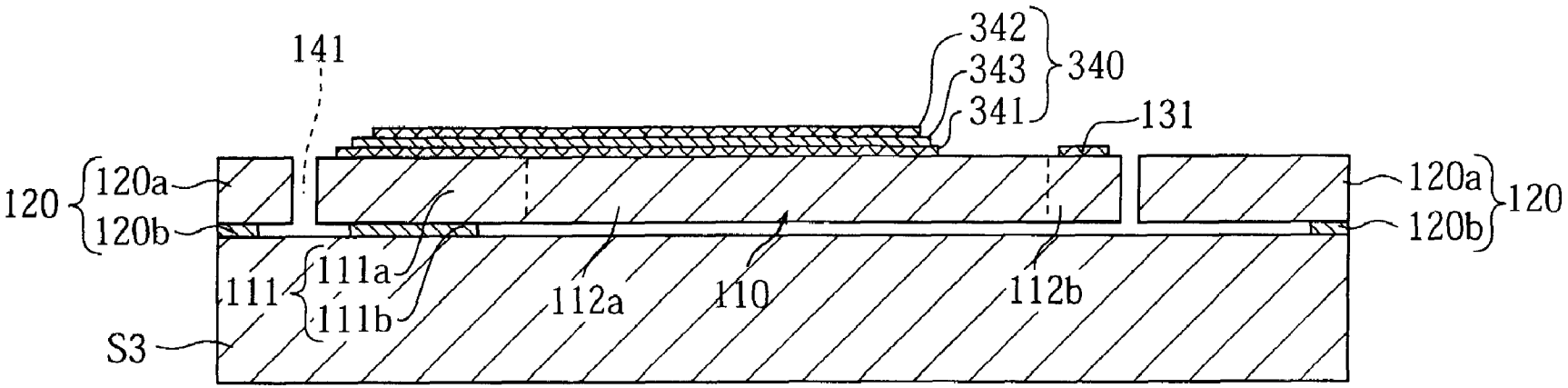
FIG. 19 is a sectional view along line XIX-XIX in FIG. 18.

FIGS. 17 to 19 show a micro-switching device X3 according to a third embodiment of the present invention. FIG. 17 is a plan view of the micro-switching device X3. FIG. 18 is a plan view of the micro-switching device X3 with some parts omitted, and FIG. 19 is a sectional view along line XIX-XIX in FIG. 18.

The micro-switching device X3 includes a base substrate S3, a movable cantilever portion 110, a fixing member 120, a movable contact conductor 131, a pair of stationary contact electrodes 132 (omitted from FIG. 18), and a piezoelectric driving segment 340. The micro-switching device X3 differs from the micro-switching device X1 in that the piezoelectric driving segment 340 is provided in place of the first driving electrode 133 and the second driving electrode 134.

The piezoelectric driving segment 340 includes a first driving electrode 341, a second driving electrode 342, and a piezoelectric film 343 provided between the two electrodes. The first driving electrode 341 and the second driving electrode 342 each has, for example, a layered structure including a Ti foundation layer and an Au main layer. The second driving electrode 342 is grounded via prescribed wiring (omitted from the drawings). The piezoelectric film 343 is made of a piezoelectric material, which exhibits strain occurring upon application of an electric field (the reverse piezoelectric effect). As this piezoelectric material, for example PZT (a solid solution of PbZrO3 and PbTiO3), Mn-doped ZnO, ZnO, or AlN can be used. The thicknesses of the first driving electrode 341 and the second driving electrode 342 are, for example, 0.55 μm, and the thickness of the piezoelectric film 343 is, for example, 1.5 μm.

The base substrate S3, the movable portion 110, the fixing member 120, the contact conductor 131, and the pair of stationary contact electrodes 132 are constituted as described earlier for the micro-switching device X1.

With the micro-switching device X3 having the above arrangement, when a prescribed potential is applied to the first driving electrode 341, an electric field is generated between the first driving electrode 341 and the second driving electrode 342, and hence a contractive force in the in-plane (or longitudinal) direction arises within the piezoelectric film 343. The further from the first driving electrode 341, which is supported directly by the extending part 112, i.e. the closer to the second driving electrode 342, the more easily the piezoelectric material in the piezoelectric film 343 contracts in the in-plane direction. The amount of contraction in the in-plane direction caused by the contractive force thus becomes progressively greater from the first driving electrode 341 side toward the second driving electrode 342 side within the piezoelectric film 343, and hence the extending part 112 elastically deforms to a position in which the contact conductor 131 contacts the pair of stationary contact electrodes 132. In this way, the closed state of the micro-switching device X3 is achieved. In this closed state, the stationary contact electrodes 132 are electrically bridged by the contact conductor 131, and hence a current is allowed to pass between the stationary contact electrodes 132.

With the micro-switching device X3 in the closed state, if the electric field between the first driving electrode 341 and the second driving electrode 342 is eliminated by stopping the application of the voltage to the first driving electrode 341, then the piezoelectric film 343 and the extending part 112 return to their natural states, and hence the contact conductor 131 separates away from the stationary contact electrodes 132. In this way, the open state of the micro-switching device X3 is achieved. In the open state, the stationary contact electrodes 132 are electrically isolated from one another, and hence a current is prevented from passing between the stationary contact electrodes 132.

FIGS. 20A-20D, 21A-21C, 22A-22C and 23A-23C illustrate a method of manufacturing the micro-switching device X3 through successive changes in two cross sections of the material substrate, one cross section (on the left) taken along line XX-XX in FIG. 17, the other (on the right) taken along line XXI-XXI in FIG. 17.

Figures 20A, 20B, 20C, 20D:
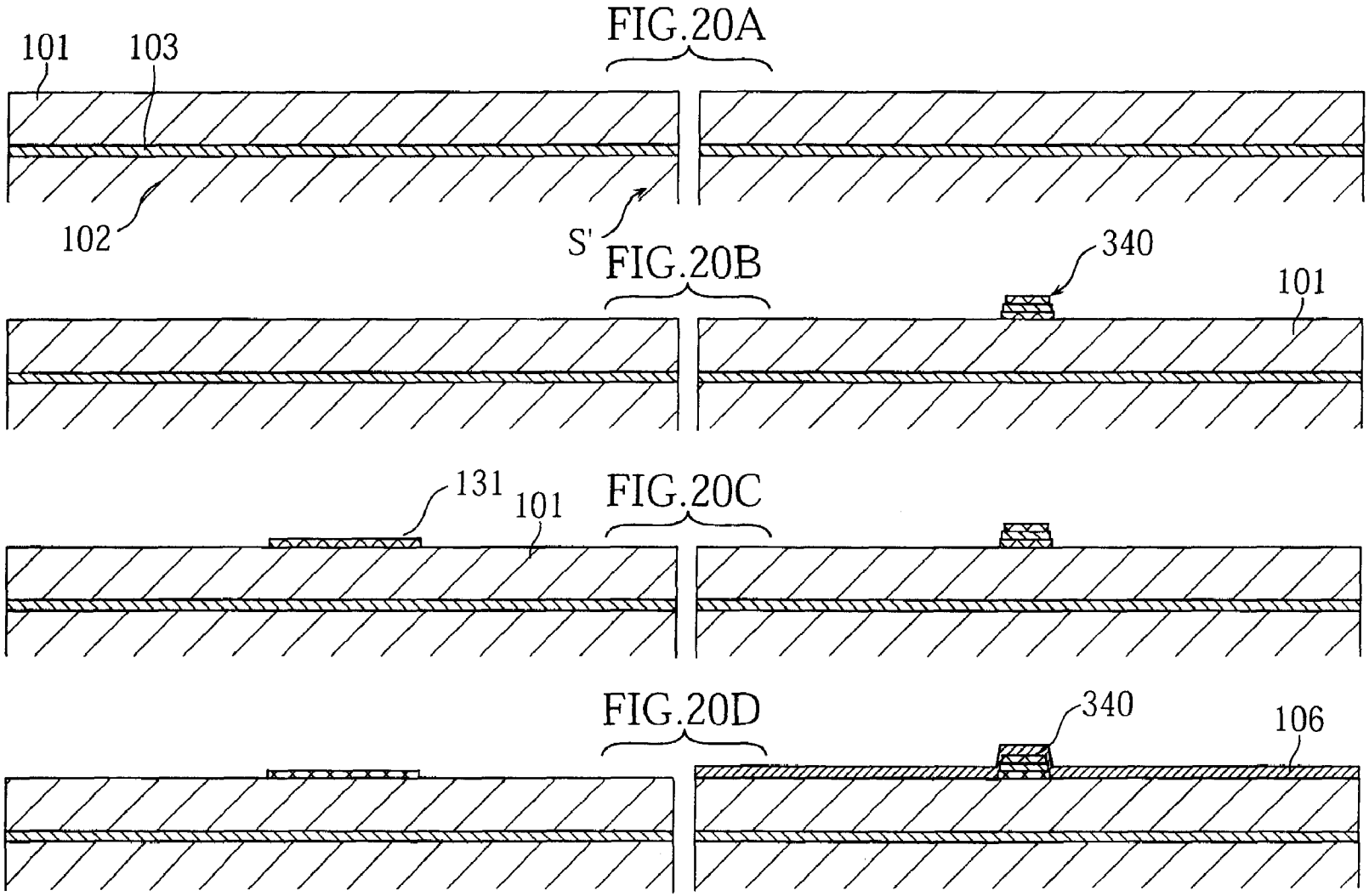
FIGS. 20A-20D show some of the steps in a method of manufacturing the micro-switching device of FIG. 17.

In the manufacture of the micro-switching device X3, first a substrate S' as shown in FIG. 20A is prepared. The substrate S' is an SOI substrate, and has a layered structure comprising a first layer 101, a second layer 102, and an intermediate layer 103 therebetween. In the present embodiment, for example, the thickness of the first layer 101 is 10 μm, the thickness of the second layer 102 is 400 μm, and the thickness of the intermediate layer 103 is 2 μm. The first layer 101 and the second layer 102 are made, for example, of monocrystalline silicon. In the present embodiment, the intermediate layer 103 is made of an insulating material. As this insulating material, use may be made of silicon dioxide, silicon nitride or the like.

Next, as shown in FIG. 20B, the piezoelectric driving segment 340 is formed on the first layer 101 of the substrate S'. In the formation of the piezoelectric driving segment 340, a first electroconductive film is formed on the first layer 101. Next, a piezoelectric material film is formed on the first electroconductive film. Then, a second electroconductive film is formed on the piezoelectric material film. After that, the films are patterned using photolithography and then etching. The first and second electroconductive films can be formed, for example, using a sputtering method by forming a film of, for example, Ti, and then forming a film of, for example, Au thereon. The thickness of the Ti film is, for example, 50 nm, and the thickness of the Au film is, for example, 500 nm. The piezoelectric material film can be formed, for example, using a sputtering method by forming a film of an appropriate piezoelectric material.

Next, as shown in FIG. 20C, the contact conductor 131 is formed on the first layer 101 in the same manner as described earlier with reference to FIG. 6B for the formation of the contact conductor 131 of the micro-switching device X1.

Next, as shown in FIG. 20D, a protective film 106 for covering the piezoelectric driving segment 340 is formed. For example, the protective film 106 can be formed by forming a film of Si using a sputtering method via a prescribed mask. The thickness of the protective film 106 is, for example, 300 nm.

Figures 21A, 21B, 21C:
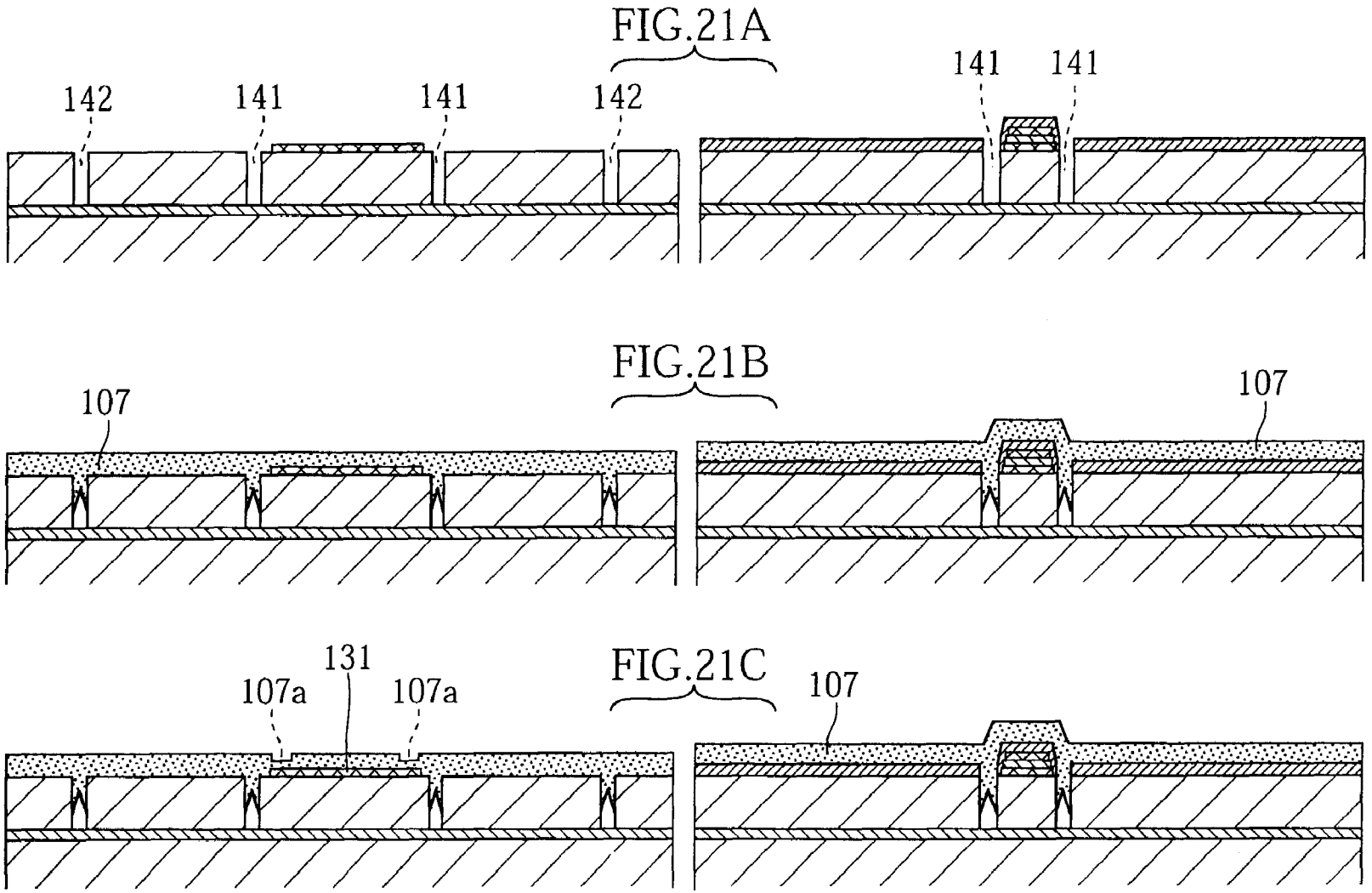
FIGS. 21A-21C show steps following the step of FIG. 20D.

In the manufacture of the micro-switching device X3, as shown in FIG. 21A, the first layer 101 is subjected to etching treatment for forming the slits 141 and 142. This process is performed in the same manner as described earlier with reference to FIG. 6C for manufacturing the micro-switching device X1.

Next, as shown in FIG. 21B, a sacrificial layer 107 is formed on the first layer 101 side of the substrate S' such as to block up the slits 141 and 142. This process is performed in the same manner as described earlier with reference to FIG. 6D for the formation of the sacrificial layer 104.

Next, as shown in FIG. 21C, two recesses 107*a* are formed in the sacrificial layer 107 in places in correspondence with the contact conductor 131. The process is performed in the same manner as described earlier with reference to FIG. 7A for the formation of the recesses 104*a*. Each of the recesses 107*a* is for forming the contacting part 132*a* of one of the stationary contact electrodes 132, and has a depth of, for example, 1 μm.

Figures 22A, 22B, 22C:
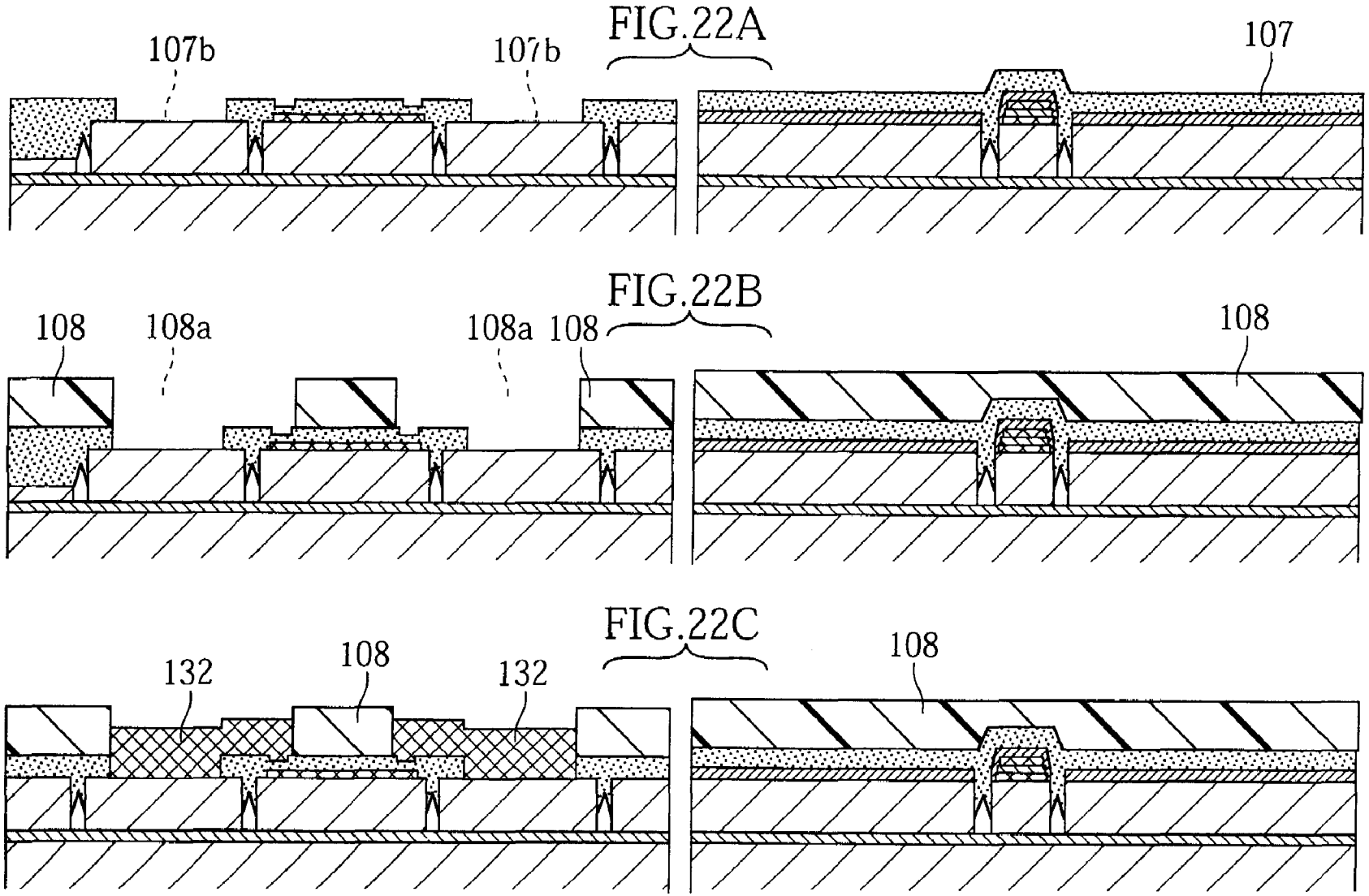
FIGS. 22A-22C show steps following the step of FIG. 21C.

Next, as shown in FIG. 22A, the sacrificial layer 107 is patterned, thus forming openings 107*b*. Specifically, a prescribed resist pattern is formed on the sacrificial layer 107 using a photolithography method, and then the sacrificial layer 107 is subjected to etching treatment using the resist pattern as a mask. Wet etching can be used as the etching method. The openings 107*b* are for exposing regions where the stationary contact electrodes 132 will be joined to the island plinths 121 of the fixing member 120.

Next, a foundation film (omitted from the drawings) for passing electricity is formed on the surface of the substrate S' on the side on which the sacrificial layer 107 has been provided, and then as shown in FIG. 22B, a mask 108 is formed. The foundation film can be formed, for example, using a sputtering method by forming a Cr film of thickness 50 nm, and then forming an Au film of thickness 500 nm thereon. The mask 108 has openings 108*a* in correspondence with the pair of stationary contact electrodes 132.

Next, as shown in FIG. 22C, the stationary contact electrodes 132 are formed. Specifically, for example gold is grown using an electroplating method on the foundation film exposed in the openings 108*a*.

Figures 23A, 23B, 23C:
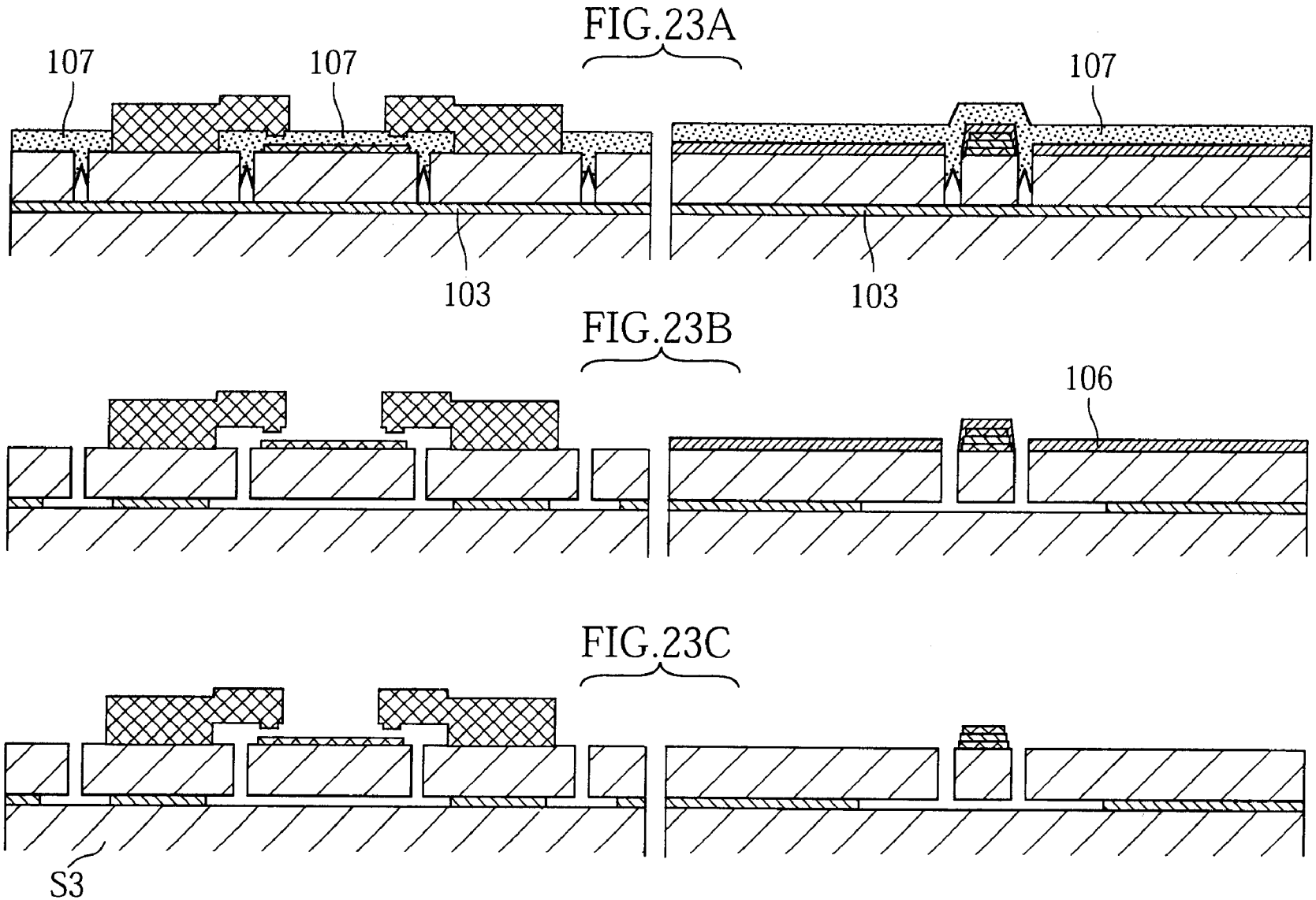
FIGS. 23A-23C show steps following the step of FIG. 22C.
Figure 24:
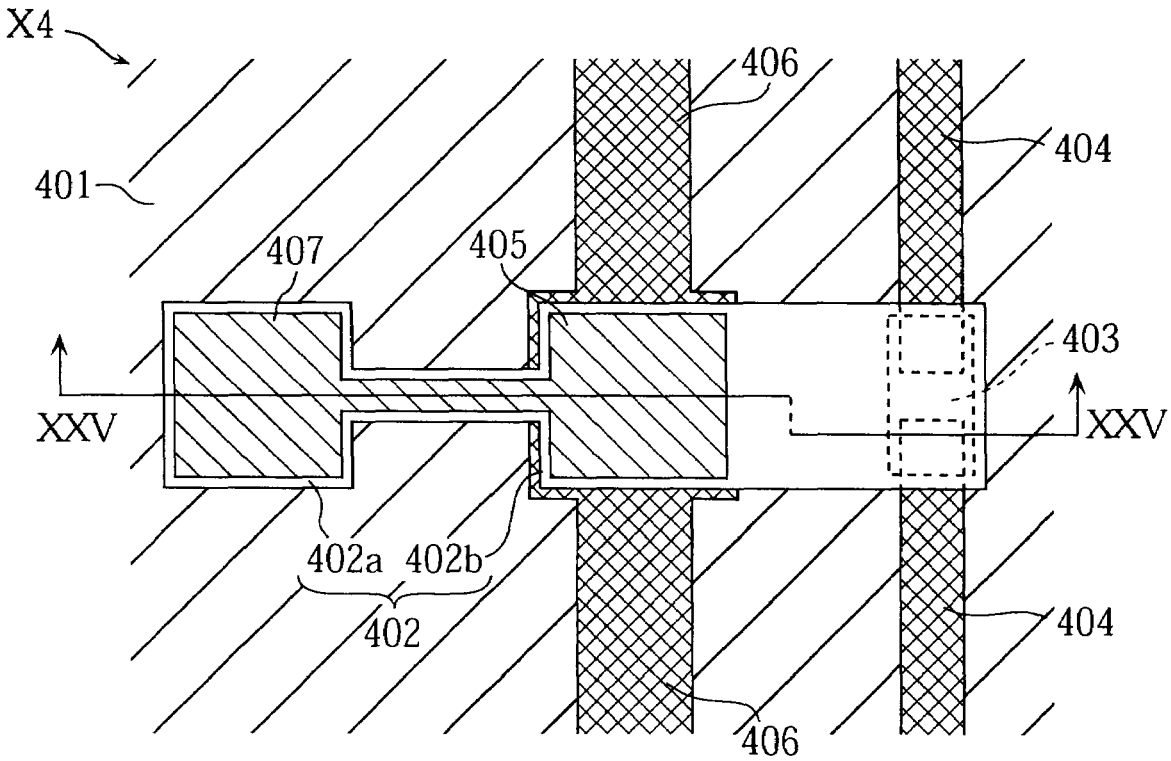
FIG.24 PRIOR ART
FIG. 24 is a partial plan view of a conventional micro-switching device manufactured using MEMS technology.
Figure 25:
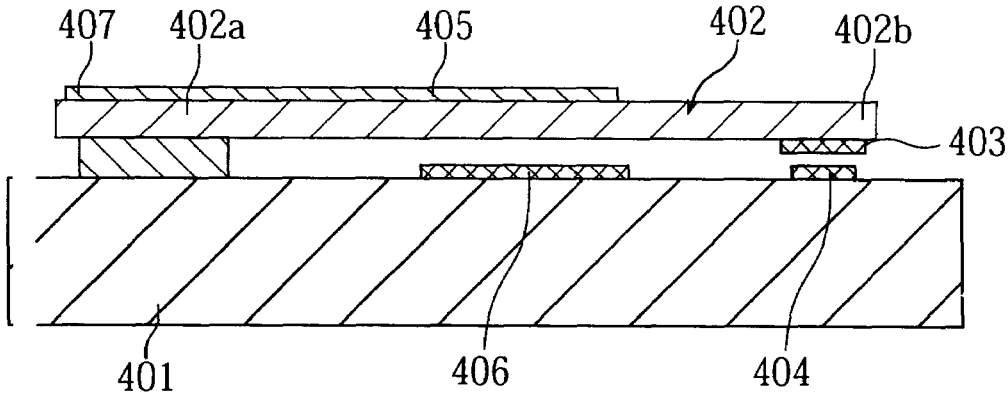
FIG.25 PRIOR ART
FIG. 25 is a sectional view along line XXV-XXV in FIG. 24.
Figure 26A:
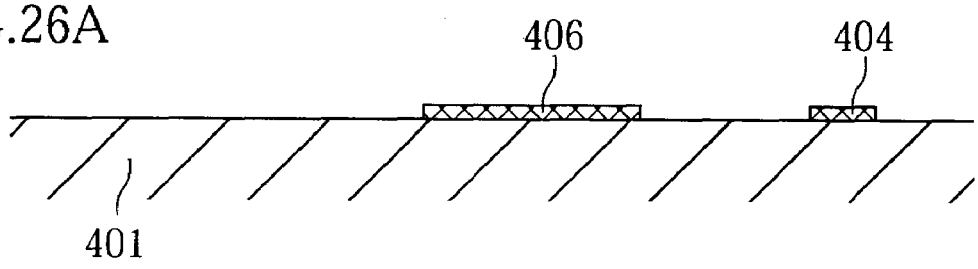
FIGS. 26A-26D show some of the steps in a method of manufacturing the micro-switching device of FIG. 24.
Figure 26B:
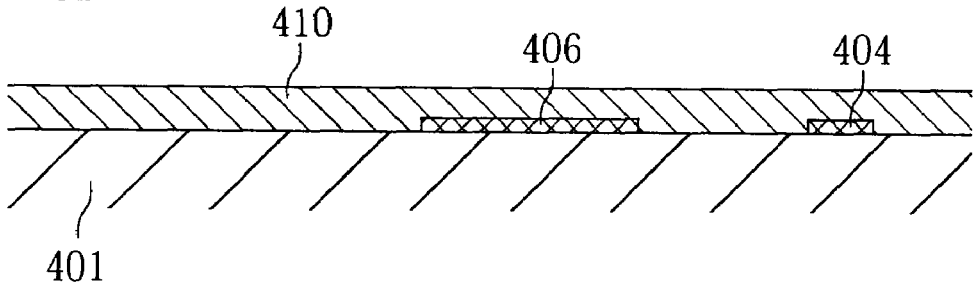
Figure 26C:
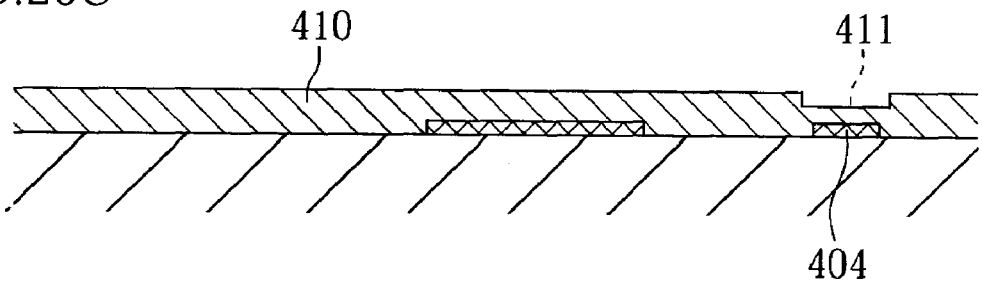
Figure 26D:
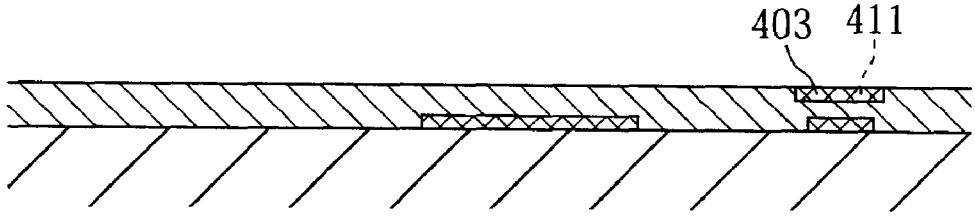
Figure 27A:
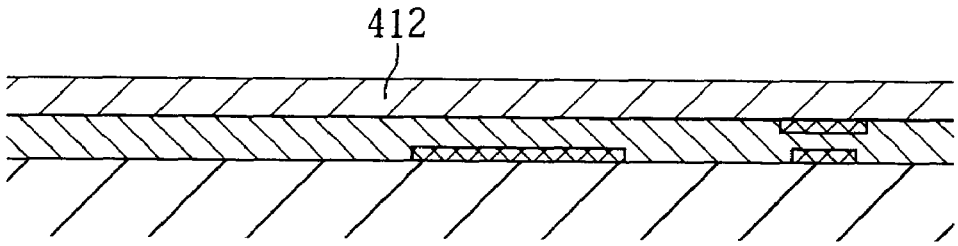
FIGS. 27A-27D show steps following the step of FIG. 26D.
Figure 27B:
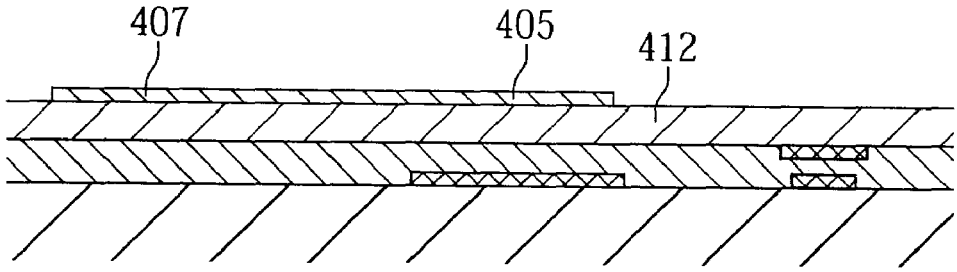
Figure 27C:
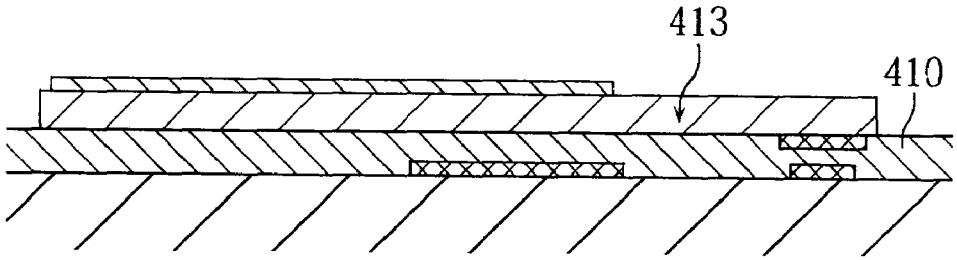
Figure 27D:
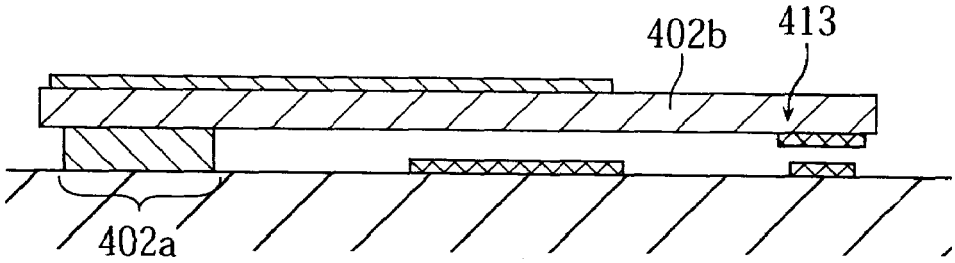

Next, as shown in FIG. 23A, the mask 108 is removed by etching. After that, the exposed parts of the foundation film are removed by etching. Wet etching can be used in each of these steps of removal.

Next, as shown in FIG. 23B, the sacrificial layer 107 and parts of the intermediate layer 103 are removed. This process is performed in the same manner as described earlier with reference to FIG. 8C for the removal of the sacrificial layer 104 and parts of the intermediate layer 103. In the present step, the boundary layer 111*b* of the anchor part 111 and the boundary layer 120*b* of the fixing member 120 are formed by being left behind. Moreover, the second layer 102 comes to constitute the base substrate S3.

Next, if necessary, the part of the foundation film (e.g. the Cr film) attached to the lower surface of each of the stationary contact electrodes 132 is removed by wet etching, and then the whole of the device is dried using a supercritical drying method. After that, as shown in FIG. 23C, the protective film 106 is removed. As the removal method, for example RIE carried out using $SF_6$ gas as an etching gas can be used.

Through the above, the micro-switching device X3 can be manufactured. With the above method, the stationary contact electrodes 132 each having a contacting part 132*a* facing the contact conductor 131 can be formed to a high thickness on the sacrificial layer 107 using plating. The thickness of the pair of stationary contact electrodes 132 can thus be set sufficiently high. Such a micro-switching device X3 is suitable for reducing the insertion loss in the closed state.

With the micro-switching device X3, the lower surface of the contacting part 132*a* of each of the stationary contact electrodes 132 (i.e. the surface that contacts the contact conductor 131) has a high degree of flatness, and hence the air gap between the contact conductor 131 and each contacting part 132*a* can be formed with high dimensional precision. Air gaps with high dimensional precision are suitable for reducing the insertion loss in the closed state, and are also suitable for improving the isolation properties in the open state.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A micro-switching device comprising:

a base substrate;

a movable portion including an anchor part and an extending part, the anchor part being connected to the base substrate, the extending part extending from the anchor part and facing the base substrate, the extending part comprises a body having an electrode carrying surface on a side opposite to the base substrate;

a stationary member connected to the base substrate;

a movable contact conductor provided on the electrode carrying surface of the extending part;

a first stationary contact electrode connected to the stationary member and including a first contacting part facing the movable contact conductor;

a second stationary contact electrode connected to the stationary member and including a second contacting part facing the movable contact conductor; and a first driving electrode formed separately from the body on the electrode carrying surface of the extending part on the same electrode carrying surface of the extending part as the movable contact conductor;

wherein the stationary member includes a stationary surrounding part and a plurality of stationary island parts each of which is connected to the base substrate and corresponds to a respective one of the first and second stationary contact electrodes, the stationary island parts being spaced away from one another, spaced away from the stationary surrounding part, and spaced away from the movable portion via slits extending along the stationary island parts and the movable portion.

2. The micro-switching device according to claim 1, wherein the stationary member is spaced away from the movable portion.

3. The micro-switching device according to claim 1, wherein the stationary member surrounds the movable portion.

4. The micro-switching device according to claim 1, further comprising a second driving electrode connected to the stationary member and including a section facing the first driving electrode.

5. The micro-switching device according to claim 1, wherein the extending part is made of monocrystalline silicon.

6. The micro-switching device according to claim 1, wherein at least one of the first stationary contact electrode and the second stationary contact electrode has a thickness of no smaller than 5 mm.

7. The micro-switching device according to claim 1, wherein the extending part has a thickness of no smaller than 5 μm.

8. The micro-switching device according to claim 1, further comprising a second driving electrode connected to the stationary member and including a section facing the first driving electrode, said section of the second driving electrode being spaced from the base substrate on a same side as the first driving electrode relative to the base substrate.

9. The micro-switching device according to claim 8, wherein said section of the second driving electrode facing the first driving electrode is farther from the base substrate than an adjoining section of the second driving electrode that is not facing the first driving electrode.

10. The micro-switching device according to claim 1, wherein the stationary surrounding pan and the plurality of stationary island parts are made by forming the stationary member as a first layer having a thickness and then etching slits trough the first layer, whereby the stationary surrounding part and the plurality of stationary island parts both have the thickness of the first layer.

* * * * *